US008725009B2

(12) United States Patent
Tomita et al.

(10) Patent No.: US 8,725,009 B2
(45) Date of Patent: May 13, 2014

(54) IMAGE FORMING APPARATUS

(75) Inventors: Daisuke Tomita, Kanagawa (JP); Shinichi Kawahara, Tokyo (JP); Takeshi Shintani, Kanagawa (JP); Nobuo Kuwabara, Kanagawa (JP); Akio Kosuge, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 166 days.

(21) Appl. No.: 13/334,918

(22) Filed: Dec. 22, 2011

(65) Prior Publication Data

US 2012/0163837 A1 Jun. 28, 2012

(30) Foreign Application Priority Data

Dec. 22, 2010 (JP) ..... 2010-285988

(51) Int. Cl.

*G03G 15/00* (2006.01)
*G03G 21/00* (2006.01)
*G03G 21/12* (2006.01)

(52) U.S. Cl.

CPC ..... *G03G 15/00* (2013.01); *G03G 21/00* (2013.01); *G03G 21/12* (2013.01)
USPC ..... 399/13; 399/35; 399/71; 399/358; 399/360

(58) Field of Classification Search

USPC ..... 399/13, 35, 71, 358, 360
See application file for complete search history.

(56) References Cited

U.S. PATENT DOCUMENTS 5,398,098 A * 3/1995 Fukunaga et al. ..... 399/110
6,181,886 B1 1/2001 Hockey et al.
6,353,722 B1 * 3/2002 Klimley et al. ..... 399/257
6,795,660 B2 * 9/2004 Yugeta et al. ..... 399/27
6,937,838 B2 * 8/2005 Ishii et al. ..... 399/358
7,050,750 B2 * 5/2006 Byun et al. ..... 399/360
7,899,345 B2 * 3/2011 Ishii ..... 399/35
7,991,308 B2 * 8/2011 Oh ..... 399/35
8,131,165 B2 * 3/2012 Yamaguchi et al. ..... 399/13
8,135,293 B2 * 3/2012 Yamaguchi et al. ..... 399/35
8,190,041 B2 * 5/2012 Kumagai ..... 399/35

(Continued)

FOREIGN PATENT DOCUMENTS

JP 5-289584 11/1993
JP 3938150 4/2007

OTHER PUBLICATIONS

Partial European Search Report issued Feb. 8, 2012 in patent application No. 11195209.9.

*Primary Examiner* — Clayton E LaBalle
*Assistant Examiner* — Kevin Butler
(74) *Attorney, Agent, or Firm* — Oblon, Spivak, McClelland, Maier & Maier & Neustadt, L.L.P.

(57) ABSTRACT

An image forming apparatus includes an image carrier, a cleaning device that collects a waste toner attached to the surface of the image carrier using a cleaning member, a waste container that is removable from an image forming apparatus body, a temporary storage unit that is provided in the image forming apparatus body to temporarily store a waste including the waste toner collected in the cleaning device before the waste is transported to the waste container, and a waste transport unit that transports the waste to the temporary storage unit, wherein a discharge speed of the waste from the temporary storage unit by the waste discharge unit is lower than a transport speed of the waste to the temporary storage unit by the waste transport unit.

18 Claims, 20 Drawing Sheets

(56) References Cited

U.S. PATENT DOCUMENTS

| | | | | |
|---|---|---|---|---|
| 8,254,823 | B2 * | 8/2012 | Nagashima et al. | 399/360 |
| 8,452,199 | B2 * | 5/2013 | Kumagai | 399/35 |
| 2003/0068167 | A1 | 4/2003 | Coriale et al. | |
| 2004/0005179 | A1 * | 1/2004 | Byun et al. | 399/358 |
| 2005/0169649 | A1 | 8/2005 | Onodera et al. | |
| 2008/0159760 | A1 * | 7/2008 | Okano et al. | 399/35 |
| 2008/0226333 | A1 | 9/2008 | Ono et al. | |
| 2009/0060536 | A1 * | 3/2009 | Kumagai | 399/35 |
| 2009/0097879 | A1 | 4/2009 | Nagashima et al. | |
| 2010/0080578 | A1 * | 4/2010 | Ichikawa | 399/34 |
| 2010/0080637 | A1 * | 4/2010 | Yamaguchi et al. | 399/358 |
| 2010/0098442 | A1 * | 4/2010 | Lee | 399/35 |
| 2010/0104299 | A1 * | 4/2010 | Oh | 399/35 |
| 2011/0091227 | A1 | 4/2011 | Tomita et al. | |
| 2011/0110694 | A1 * | 5/2011 | Ishikake | 399/360 |
| 2012/0014728 | A1 * | 1/2012 | Karasawa et al. | 399/360 |
| 2012/0163837 | A1 * | 6/2012 | Tomita et al. | 399/13 |
| 2013/0028618 | A1 * | 1/2013 | Ando et al. | 399/35 |

* cited by examiner

IMAGE FORMING APPARATUS

CROSS-REFERENCE TO RELATED APPLICATIONS

The present application claims priority to and incorporates by reference the entire contents of Japanese Patent Application No. 2010-285988 filed in Japan on Dec. 22, 2010.

The present application further incorporates by reference the entire contents of Japanese Patent Application No. 2010-060829 filed in Japan on Mar. 17, 2010.

BACKGROUND OF THE INVENTION

1. Field of the Invention

The present invention relates to an image forming apparatus.

2. Description of the Related Art

As this type of image forming apparatus, an image forming apparatus has been known which collects the waste toner attached to the surface of the image carrier using a cleaning member, transports the waste toner to a waste toner bottle (waste container) which is removable from an image forming apparatus body, and stores the waste toner in the waste toner bottle. In this structure, when the waste toner bottle is full of a waste (hereinafter, referred to as a "waste toner") including the waste toner, it is replaced with an empty waste toner bottle. In the replacement operation, in general, while the waste toner bottle is removed from the image forming apparatus body, in order to prevent the inside of the apparatus from being contaminated by the waste toner flowing out from a discharge hole of a waste toner transport path in an image forming apparatus body, it is necessary to stop an operation of transporting the waste toner from the waste toner transport path to the waste toner bottle. When an image forming operation is performed with the transport operation of the waste toner being stopped, the waste toner remains in a cleaning device, which makes it difficult to perform a normal image forming operation. In addition, the waste toner which remains in the waste toner transport path without being transported is agglutinated by the waste toner transported by the image forming operation. In this case, even after the transport operation is resumed, the agglutinated waste toner still remains in the waste toner transport path, which hinders the appropriate transport of the waste toner. For this reason, while the waste toner bottle is removed from the image forming apparatus body, in general, the image forming operation is inhibited. Therefore, the time for which the waste toner bottle is removed from the image forming apparatus body is the downtime of image formation.

Japanese Patent Application Laid-open No. 2005-242274 discloses an image forming apparatus capable of reducing the downtime. In the image forming apparatus, a buffer (temporary storage unit) capable of temporarily storing the waste toner is provided in the middle of the waste toner transport path. In the image forming apparatus, when the waste toner bottle is removed, the transport of the waste toner from the buffer to the waste toner bottle is stopped, but the operation of transporting the waste toner to the buffer is continuously performed. In this way, even when the waste toner bottle is removed from the image forming apparatus body, it is possible to continuously perform the image forming operation until the buffer is full, without causing the above-mentioned problem.

However, in the image forming apparatus disclosed in Japanese Patent Application Laid-open No. 2005-242274, the buffer includes a buffer waste toner full sensor that detects whether the buffer is full or nearly full and a buffer waste toner empty sensor that detects whether the buffer is empty. When the amount of waste toner equal to or more than a permissible amount is transported into the buffer, the waste toner in the buffer is agglutinated, which hinders the discharge of the waste toner from the buffer, or the waste toner overflows the buffer to contaminate the inside of the apparatus. Therefore, in the image forming apparatus disclosed in Japanese Patent Application Laid-open No. 2005-242274, the buffer waste toner full sensor is an indispensable component in order to prevent the amount of waste toner equal to or more than the permissible amount from being transported into the buffer. However, in the structure in which the buffer including the sensors is provided, a component cost or a manufacturing cost increases since the sensors are provided and the layout of the buffer is limited since the wiring of the sensors needs to be considered.

It is an object of the present invention to at least partially solve the problems in the conventional technology.

SUMMARY OF THE INVENTION

The above and other objects, features, advantages and technical and industrial significance of this invention will be better understood by reading the following detailed description of presently preferred embodiments of the invention, when considered in connection with the accompanying drawings.

According to an aspect of the present invention, there is provided an image forming apparatus that forms a toner image on a surface of an image carrier and transfers the formed toner image from the image carrier to a transfer body, thereby forming an image, including: a cleaning device that collects a waste toner attached to the surface of the image carrier using a cleaning member; a waste container that is removable from an image forming apparatus body; a temporary storage unit that is provided in the image forming apparatus body to temporarily store a waste including the waste toner collected in the cleaning device before the waste is transported to the waste container; a waste transport unit that transports the waste to the temporary storage unit, wherein a discharge speed of the waste from the temporary storage unit by the waste discharge unit is lower than a transport speed of the waste to the temporary storage unit by the waste transport unit; a waste discharge unit that discharges the waste stored in the temporary storage unit to the waste container, a transport amount correlation information acquiring unit that acquires transport amount correlation information correlated with the amount of waste transported into the temporary storage unit by the waste transport unit; an insertion/removal detection unit that detects the insertion or removal of the waste container into or from the image forming apparatus body; an estimated transport amount determining unit that determines an estimated amount of waste after removal, which is transported to the temporary storage unit by the waste transport unit after the detection of the removal of the waste container, on the basis of the transport amount correlation information acquired by the transport amount correlation information acquiring unit after the insertion/removal detection unit detects that the waste container is removed from the image forming apparatus body; a waste discharge control unit that stops the discharge of the waste from the temporary storage unit by the waste discharge unit when the insertion/removal detection unit detects that the waste container is removed from the image forming apparatus body, and resumes the discharge of the waste from the temporary storage unit by the waste discharge unit when the insertion/removal detection unit detects that the waste container is inserted into the image forming apparatus body; and a waste transport control unit that directs the waste transport unit to continuously transport the waste to the temporary storage unit until the estimated transport amount after removal, which is determined by the estimated transport amount determining unit, reaches a predetermined amount when the insertion/removal detection unit detects that the waste container is removed from the image forming apparatus body, directs the waste transport unit to stop the transport of the waste to the temporary storage unit when the estimated transport amount after removal, which is determined by the estimated transport amount determining unit, reaches the predetermined amount before the insertion/removal detection unit detects that the waste container is inserted into the image forming apparatus body, and directs the waste transport unit to resume the transport of the waste to the temporary storage unit if the operation of transporting the waste to the temporary storage unit by the waste transport unit is stopped when the insertion/removal detection unit detects that the waste container is inserted into the image forming apparatus body.

According to another aspect of the present invention, there is provided an image forming apparatus that forms a toner image on a surface of an image carrier and transfers the formed toner image from the image carrier to a transfer body, thereby forming an image, including: a cleaning device that collects a waste toner attached to the surface of the image carrier using a cleaning member; a waste container that is removable from an image forming apparatus body; a temporary storage unit that is provided in the image forming apparatus body to temporarily store a waste including the waste toner collected in the cleaning device before the waste is transported to the waste container; a waste transport unit that transports the waste to the temporary storage unit; a waste discharge unit that discharges the waste stored in the temporary storage unit to the waste container, wherein a discharge speed of the waste from the temporary storage unit by the waste discharge unit is lower than a transport speed of the waste to the temporary storage unit by the waste transport unit; a door only for a waster container that is used to replace the waste container; a transport amount correlation information acquiring unit that acquires transport amount correlation information correlated with the amount of waste transported to the temporary storage unit by the waste transport unit; an insertion/removal detection unit that detects the insertion or removal of the waste container into or from the image forming apparatus body; a dedicated door opening/closing detection unit that detects the opening or closing of the door only for a waster container; an estimated transport amount determining unit that determines an estimated amount of waste after an opening operation which is transported to the temporary storage unit by the waste transport unit after the dedicated door opening/closing detection unit detects that the door only for a waster container is opened, based on the transport amount correlation information acquired by the transport amount correlation information acquiring unit after the dedicated door opening/closing detection unit detects that the door only for a waster container is opened; a waste discharge control unit that stops the discharge of the waste from the temporary storage unit by the waste discharge unit when the dedicated door opening/closing detection unit detects that the door only for a waster container is opened, and resumes the discharge of the waste from the temporary storage unit by the waste discharge unit when the insertion/removal detection unit detects that the waste container is inserted into the image forming apparatus body and the dedicated door opening/closing detection unit detects that the door only for a waster container is closed; and a waste transport control unit that directs the waste transport unit to continuously transport the waste to the temporary storage unit until the estimated transport amount after an opening operation which is determined by the estimated transport amount determining unit reaches a predetermined amount when the dedicated door opening/closing detection unit detects that the door only for a waster container is opened, directs the waste transport unit to stop the transport of the waste to the temporary storage unit when the estimated transport amount after an opening operation which is determined by the estimated transport amount determining unit reaches the predetermined amount before the dedicated door opening/closing detection unit detects that the door only for a waster container is closed, and directs the waste transport unit to resume the transport of the waste to the temporary storage unit when the insertion/removal detection unit detects that the waste container is inserted into the image forming apparatus body and the dedicated door opening/closing detection unit detects that the door only for a waster container is closed.

BRIEF DESCRIPTION OF THE DRAWINGS

FIG. 12 is a flowchart illustrating the flow of control related to the replacement of the waste toner bottle when power is turned on;

DETAILED DESCRIPTION OF THE PREFERRED EMBODIMENTS

Hereinafter, an image forming apparatus according to an exemplary embodiment of the invention will be described.

First, the structure and operation of the image forming apparatus according to this embodiment will be described.

Figure 1:
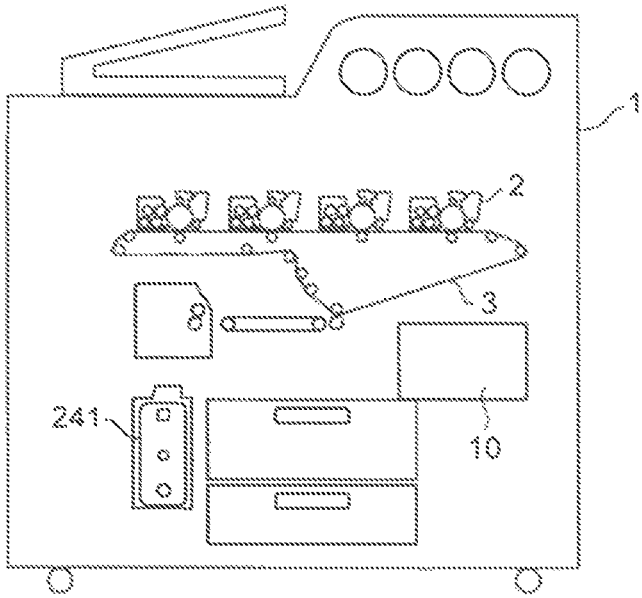
FIG. 1 is a diagram schematically illustrating the structure of an image forming apparatus according to an embodiment.

FIG. 1 is a diagram schematically illustrating the structure of the image forming apparatus according to this embodiment.

An image forming apparatus 1 includes a control unit 10 and an image forming unit in which four image forming units 2 are arranged in parallel. Each of the image forming units 2 includes a drum-shaped photosensitive element, which is a latent image carrier, a charging unit, a two-component developing unit, and a drum cleaning device which are supported by a common unit frame. Each of the image forming units 2 is configured so as to be removable from an image forming apparatus body.

An exposure unit is provided as a latent image forming unit above the image forming unit. A reading device that scans a document on a contact glass and reads data from the document is provided at an upper part of the apparatus. A transfer unit including an intermediate transfer belt 3, which is an intermediate transfer body, is provided below the image forming unit. The intermediate transfer belt 3 is wound around a plurality of supporting rollers and is endlessly rotated in the clockwise direction of FIG. 1. A secondary transfer device is provided below the transfer unit. The secondary transfer device includes a secondary transfer roller. The secondary transfer roller comes into contact with the surface of the intermediate transfer belt 3 at a position where the intermediate transfer belt 3 is wound around a transfer opposite roller to form a secondary transfer nip. A secondary transfer bias is applied from a power supply (not shown) to the secondary transfer roller. The transfer opposite roller is electrically connected to the ground. In this way, a secondary transfer electric field is formed in the secondary transfer nip. A fixing unit including a heating roller having a heating body provided therein is provided on the left side of the secondary transfer device in FIG. 1 in order to fix a toner image transferred onto a sheet. A transport belt that transports the sheet having the toner image transferred thereon to the fixing unit is provided between the secondary transfer device and the fixing unit. A paper feeding unit that feeds the sheets which are separated one by one and then transported from a paper storage (not shown) to the secondary transfer device is provided at a lower part of the apparatus. In addition, a discharge unit is provided which conveys the sheet passing through the fixing unit to the outside of the apparatus or a duplex unit.

When the image forming apparatus copies a document, the reading device reads the document. In parallel to the reading of the document, the intermediate transfer belt 3 is rotated in the clockwise direction of FIG. 1. At the same time, in the image forming unit, the exposure unit emits light to each photosensitive element with the surface which is uniformly charged with a predetermined charging potential by each charging unit, using yellow, magenta, cyan, and black color information on the basis of the content of the read document, thereby forming latent images. Then, the developing unit develops the latent images on each photosensitive element to form monochromatic toner images. Then, the toner images on each photosensitive element are sequentially transferred onto the intermediate transfer belt 3 so as to overlap each other, thereby forming a combined toner image on the intermediate transfer belt 3.

After the toner images are transferred, a drum cleaning device removes the toner remaining on each photosensitive element and prepares to form another image.

In parallel to the toner image forming operation, the sheets are repeatedly transported one by one from the paper storage (not shown) and collide with a pair of registration rollers. Then, the pair of registration rollers rotated at the time when the combined toner image on the intermediate transfer belt 3 reaches the secondary transfer nip and transports the sheet into the secondary transfer nip, and the secondary transfer device transfers the combined toner image onto the sheet. The sheet having the toner image transferred thereon is transported to the fixing unit by the transport belt and the fixing unit applies heat and pressure to the sheet to fix the toner image. Then, the sheet is transported to the ejecting unit.

The ejecting unit changes switching claws to guide the sheet to a discharge tray (not shown) outside the apparatus (the left side of the apparatus) or the duplex unit (not shown) provided at a lower part of the apparatus. The duplex unit reverses the sheet and transports it to the secondary transfer nip again such that an image is recorded on the rear surface of the sheet. Then, the ejecting unit discharges the sheet onto the discharge tray. After the image is transferred, an intermediate transfer belt cleaning unit removes the toner remaining on the intermediate transfer belt 3 and prepares to form another image.

Next, nonstop waste toner bottle replacement control, which is a characteristic portion of the invention, capable of performing an image forming operation even when a waste toner bottle, which is a waste container, is removed from the image forming apparatus body will be described below.

Figure 2:
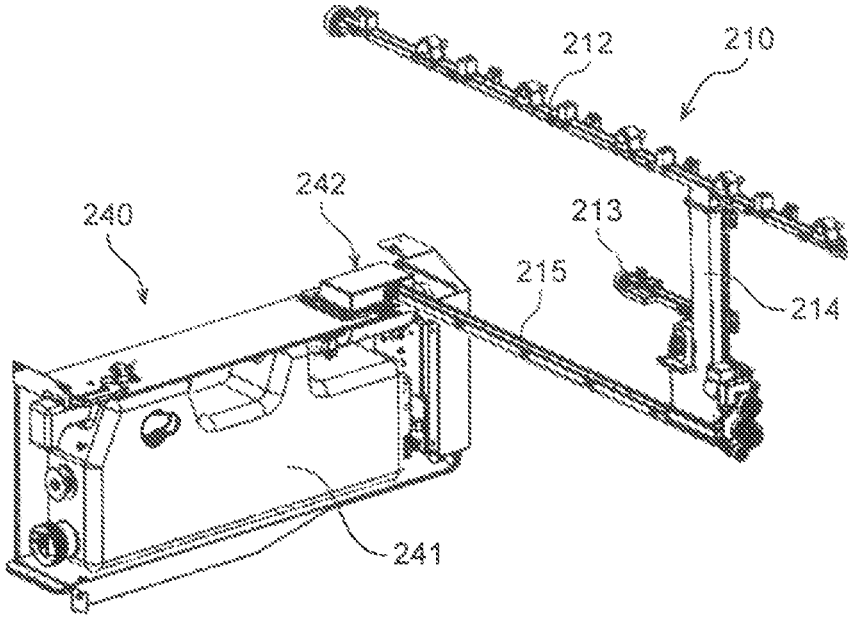
FIG. 2 is a perspective view illustrating a waste toner transport path and a waste toner collecting unit to which a waste toner bottle is set in an image forming apparatus body.

FIG. 2 is a perspective view illustrating a waste toner transport path 210 and a waste toner collecting unit 240 having a waste toner bottle 241 set thereto in the image forming apparatus body.

In this embodiment, first, an excess lubricant and an excess toner discharged from the cleaning device provided in each image forming unit 2 is transported to a first main body transport unit 212 of the waste toner transport path 210. In the structure in which an excess developer is discharged from the developing unit provided in each image forming unit 2, the excess developer is also transported to the first main body transport unit 212. The excess lubricant, and the excess toner or the excess developer (hereinafter, referred to as a "waste toner" including the excess developer) in the first main body transport unit 212 is transported to the upper end of a drop path unit 214 of the waste toner transport path 210 by a first main-body-side waste toner transport screw (not shown), which is a transport member in the first main body transport unit 212. The waste toner transported to the upper end of the drop path unit 214 drops into the drop path unit 214 and is sent into a third main body transport unit 215 communicating with the lower end of the drop path unit 214. A second main body transport unit 213 connected to the intermediate transfer belt cleaning unit is connected to the middle of the drop path unit 214. For example, the excess toner which has been collected in the intermediate transfer belt cleaning unit and then transported into the second main body transport unit 213 is sent into the drop path unit 214 by a second main-body-side waste toner transport screw (not shown), which is a transport member in the second main body transport unit 213, drops into the drop path unit 214, and is transported into the third main body transport unit 215. The waste toner transported into the third main body transport unit 215 is sent to the downstream end of the third main body transport unit 215 in the transport direction by a third main-body-side waste toner transport screw (not shown), which is a transport member in the third main body transport unit 215.

Figure 3:
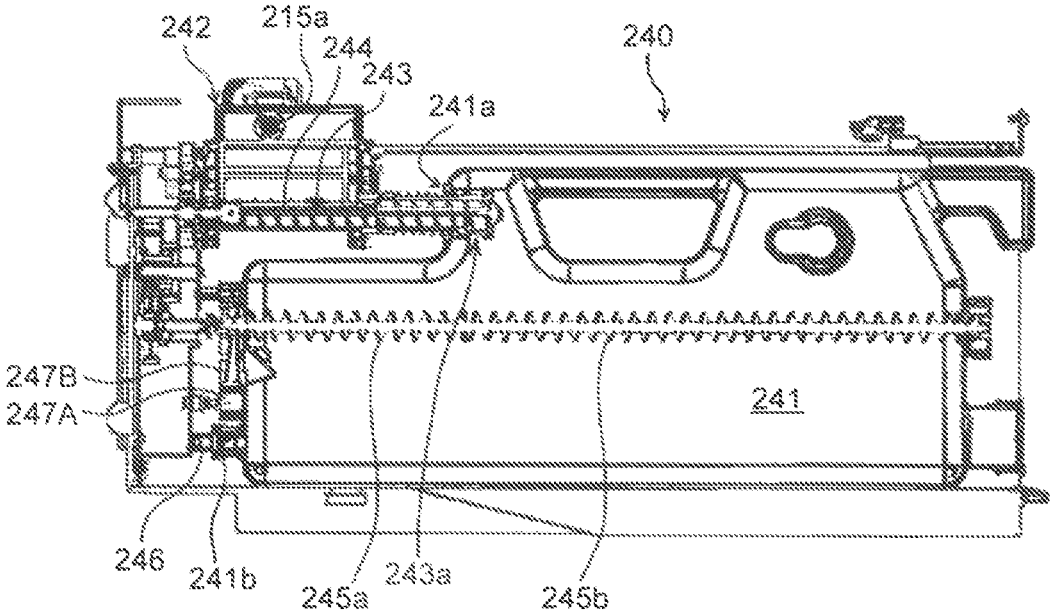
FIG. 3 is a cross-sectional view illustrating the internal structure of the waste toner collecting unit.

FIG. 3 is a cross-sectional view illustrating the internal structure of the waste toner collecting unit 240.

A temporary storage unit 242 which is provided at an upper part of the waste toner collecting unit 240 is connected to the downstream end of the third main body transport unit 215 in the transport direction. An outlet 215*a* at the downstream end of the third main body transport unit 215 in the transport direction is formed at the upper part of the temporary storage unit 242 and the waste toner discharged from the outlet 215*a* drops into the temporary storage unit 242. A waste toner transport path 243 for a temporary storage unit is formed below the temporary storage unit 242. An outlet 243*a* is provided at the downstream end of the waste toner transport path 243 for a temporary storage unit in the transport direction. The waste toner in the waste toner transport path 243 for a temporary storage unit is transported to the outlet 243*a* by a temporary storage unit transport screw 244. When the waste toner bottle 241 is set in the waste toner collecting unit 240, the downstream end of the waste toner transport path 243 for a temporary storage unit in the transport direction is inserted into a receiving hole 241*a* which is formed at an upper part of the waste toner bottle 241. In this case, the outlet 243*a* of the waste toner transport path 243 for a temporary storage unit is inserted into the waste toner bottle 241. Therefore, the waste toner discharged from the outlet 243*a* of the waste toner transport path 243 for a temporary storage unit drops into the waste toner bottle 241 and is then stored therein.

Two in-bottle transport screws 245*a* and 245*b* that transport toner in the opposite direction are provided in the waste toner bottle 241. The two in-bottle transport screws 245*a* and 245*b* are connected to each other below the outlet 243*a* of the waste toner transport path 243 for a temporary storage unit, with the waste toner bottle 241 being set. The two in-bottle transport screws 245*a* and 245*b* transport the waste toner so as to be separated from the connection portion. In this way, the waste toner which has dropped from the outlet 243*a* of the waste toner transport path 243 for a temporary storage unit and has been deposited can be uniformly spread in the entire waste toner bottle 241. Therefore, it is possible to store a large amount of waste toner in the waste toner bottle 241.

A near full sensor 247A which detects that the waste toner bottle 241 is close to a full level (near full state) and a full sensor 247B which detects that the waste toner bottle 241 is in a full state are provided in the waste toner collecting unit 240. The sensors 247A and 247B have the same structure, but are arranged at different heights. The near full sensor 247A is arranged at a low position and the full sensor 247B is arranged at a high position. The sensors 247A and 247B output detection signals when the waste toner is filled up to the arrangement positions of the sensors in the waste toner bottle 241, and known sensors may be widely used as the sensors. Hereinafter, the state in which neither the near full sensor 247A nor the full sensor 247B outputs the detection signal is referred to as a "normal state", the state in which the near full sensor 247A outputs the detection signal is referred to as a "near full state", and the state in which the full sensor 247B outputs the detection signal is referred to as a "full state".

In addition, a set detection sensor 246 serving as an insertion/removal detection unit that detects whether the waste toner bottle 241 is set is provided in the waste toner collecting unit 240. When the waste toner bottle 241 is pressed to a set position, a detecting protrusion 241*b* provided at the leading end (the left side of FIG. 3) of the waste toner bottle 241 in the insertion direction presses a movable portion of the set detection sensor 246 to the leading end side in the insertion direction. In this way, the set detection sensor 246 detects a bottle set state in which the waste toner bottle 241 is set. When the waste toner bottle 241 is removed from the set position, the pressing force against the movable portion of the set detection sensor 246 is removed and the set detection sensor 246 detects a bottle unset state in which the waste toner bottle 241 is not set.

In this embodiment, the main-body-side waste toner transport member that transports the waste toner functions as a waste transport unit that transports the waste toner to the temporary storage unit 242, and the temporary storage unit transport screw 244 functions as a waste discharge unit that discharges the waste toner in the temporary storage unit 242 to the waste toner bottle 241. In this embodiment, when the waste toner bottle 241 which is not in the full state is set, the main-body-side waste toner transport member and the temporary storage unit transport screw 244 are driven in synchronization with the image forming operation. In this embodiment, the main-body-side waste toner transport member and the temporary storage unit transport screw 244 are driven in synchronization with the rotation of the photosensitive elements.

In this embodiment, the discharge speed of the waste toner from the temporary storage unit 242 by the temporary storage unit transport screw 244 is higher than the transport speed of the waste toner to the temporary storage unit 242 by the third main-body-side waste toner transport screw in the third main body transport unit 215 of the image forming apparatus body. For example, a method of changing the number of screw threads, a screw pitch, a screw angle, and the number of rotations of a screw shaft is used as a method of changing the transport speed of the temporary storage unit transport screw 244 or the third main-body-side waste toner transport screw. In this embodiment, the temporary storage unit 242 is configured such that the waste toner discharge speed is higher than the waste toner transport speed. Therefore, in the normal state, the amount of waste toner in the temporary storage unit 242 is stably maintained at the minimum value close to a substantially empty state. Hereinafter, the state in which the amount of waste toner in the temporary storage unit 242 is the minimum is referred to as an "empty state" and the state in which the amount of waste toner in the temporary storage unit 242 is more than the minimum value is referred to as a "non-empty state".

Figure 4:
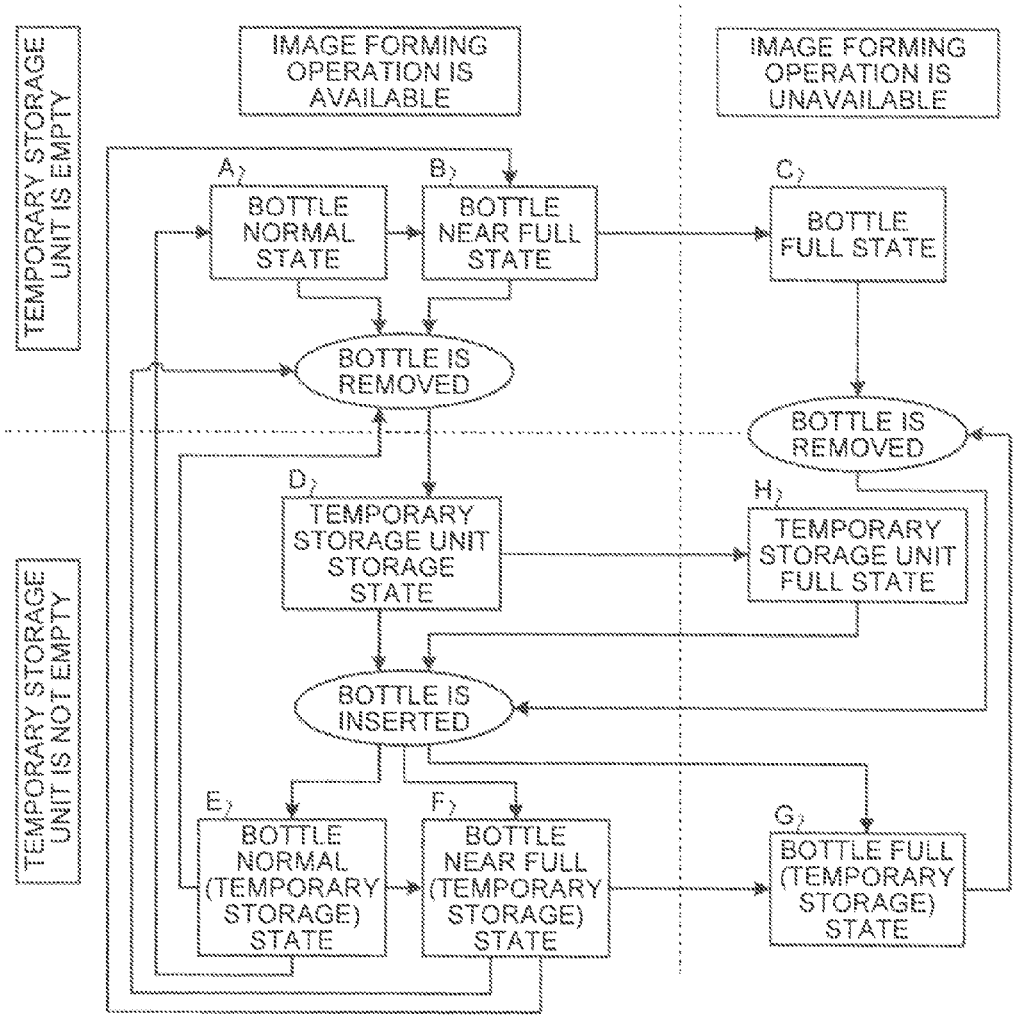
FIG. 4 is a state transition diagram illustrating various kinds of states related to the replacement of the waste toner bottle.

FIG. 4 illustrates a state transition diagram describing various states related to the replacement of the waste toner bottle according to this embodiment.

In this embodiment, when the image forming operation is performed in a bottle normal state A in which the waste toner bottle 241 is in the normal state and the temporary storage unit 242 is in the empty state, the waste toner is sequentially stored in the waste toner bottle 241. Then, the image forming apparatus changes to a bottle near full state B in which the temporary storage unit 242 is in the empty state and the waste toner bottle 241 is in the near full state. In the bottle near full state B, a near full notice indicating that the waste toner bottle 241 is going to be full of the waste toner is transmitted to the user. In this case, the image forming operation can be normally performed. When the image forming operation is continuously performed without replacing the waste toner bottle 241 in the bottle near full state B, the image forming apparatus changes to a bottle full state C in which the temporary storage unit 242 is in the empty state and the waste toner bottle 241 is in the full state. In the bottle full state C, a full notice for prompting the user to replace the waste toner bottle 241 is transmitted to the user and the image forming operation is inhibited.

In the related art, in any one of the bottle normal state A, the bottle near full state B, and the bottle full state C in which the temporary storage unit 242 is the empty state, when the user removes the waste toner bottle 241 from the image forming apparatus body, the image forming operation is inhibited. In contrast, in this embodiment, the image forming apparatus changes to a temporary storage unit storage state D in which the image forming operation can be performed.

Specifically, when the set detection sensor 246 detects the bottle unset state, the image forming apparatus changes to the temporary storage unit storage state D and the driving of the temporary storage unit transport screw 244 in the waste toner transport path 243 for a temporary storage unit is instantaneously stopped. In this way, it is possible to prevent the waste toner from being discharged from the outlet 243*a* of the waste toner transport path 243 for a temporary storage unit with the waste toner bottle 241 being removed. The in-bottle transport screws 245*a* and 245*b* in the waste toner bottle 241 are driven by the same driving source as that driving the temporary storage unit transport screw 244 and are rotated in synchronization with the temporary storage unit transport screw 244. Therefore, when the set detection sensor 246 detects the bottle unset state, the driving of the in-bottle transport screws 245*a* and 245*b* is instantaneously stopped. However, since the waste toner transport member in the image forming apparatus body is continuously driven, the waste toner is sequentially transported to the temporary storage unit 242. Then, when the image forming operation is continuously performed in the temporary storage unit storage state D and the image forming apparatus changes to a temporary storage unit full state H in which the temporary storage unit 242 is full, the image forming operation is inhibited.

In this embodiment, in any one of the temporary storage unit storage state D and the temporary storage unit full state H in which the waste toner bottle is removed, when the user inserts (sets) the waste toner bottle 241 into the image forming apparatus body, the image forming apparatus changes to any one of the following three states, depending on the state of the set waste toner bottle 241. That is, the image forming apparatus changes to a bottle normal (temporary storage unit discharge) state E, a bottle near full (temporary storage unit discharge) state F, and a bottle full state G. The difference between the bottle normal (temporary storage unit discharge) state E and the bottle normal state A is that the temporary storage unit is not empty in the bottle normal state E and the temporary storage unit is empty in the bottle normal state A. The difference between the bottle near full (temporary storage unit discharge) state F and the bottle near full state B is similar to the difference between the bottle full state G and the bottle full state C.

In the bottle normal (temporary storage unit discharge) state E and the bottle near full (temporary storage unit discharge) state F, the image forming operation can be normally performed. However, in the bottle full state G, the image forming operation is inhibited. Therefore, in the bottle full state G, it is difficult to perform the image forming operation unless the waste toner bottle 241 is replaced with a new one which is not full. When the image forming operation is performed in the bottle normal (temporary storage unit discharge) state E and the bottle near full (temporary storage unit discharge) state F, the waste toner is sequentially stored in the waste toner bottle 241. In this case, the amount of waste toner corresponding to the image forming operation for the time when the waste toner bottle 241 is removed remains in the temporary storage unit 242. In this embodiment, as described above, since the discharge speed of the waste toner to the temporary storage unit 242 is higher than the waste toner transport speed, the amount of waste toner in the temporary storage unit 242 is gradually reduced with the execution of the image forming operation (with an increase in the driving time of the temporary storage unit transport screw 244). When the driving time of the temporary storage unit transport screw 244 reaches the time when the amount of waste toner in the temporary storage unit 242 becomes a normal state, the temporary storage unit changes to the empty state and the image forming apparatus changes to the bottle normal state A or the bottle near full state B.

In this embodiment, neither the sensor detecting whether the temporary storage unit 242 is in the full state nor the sensor detecting whether the temporary storage unit 242 is in the empty state is provided in the temporary storage unit 242. However, the following nonstop waste toner bottle replacement control is performed to accurately predict whether the temporary storage unit 242 is in the full state, without using these sensors.

Control of Bottle Normal State A

Figure 5:
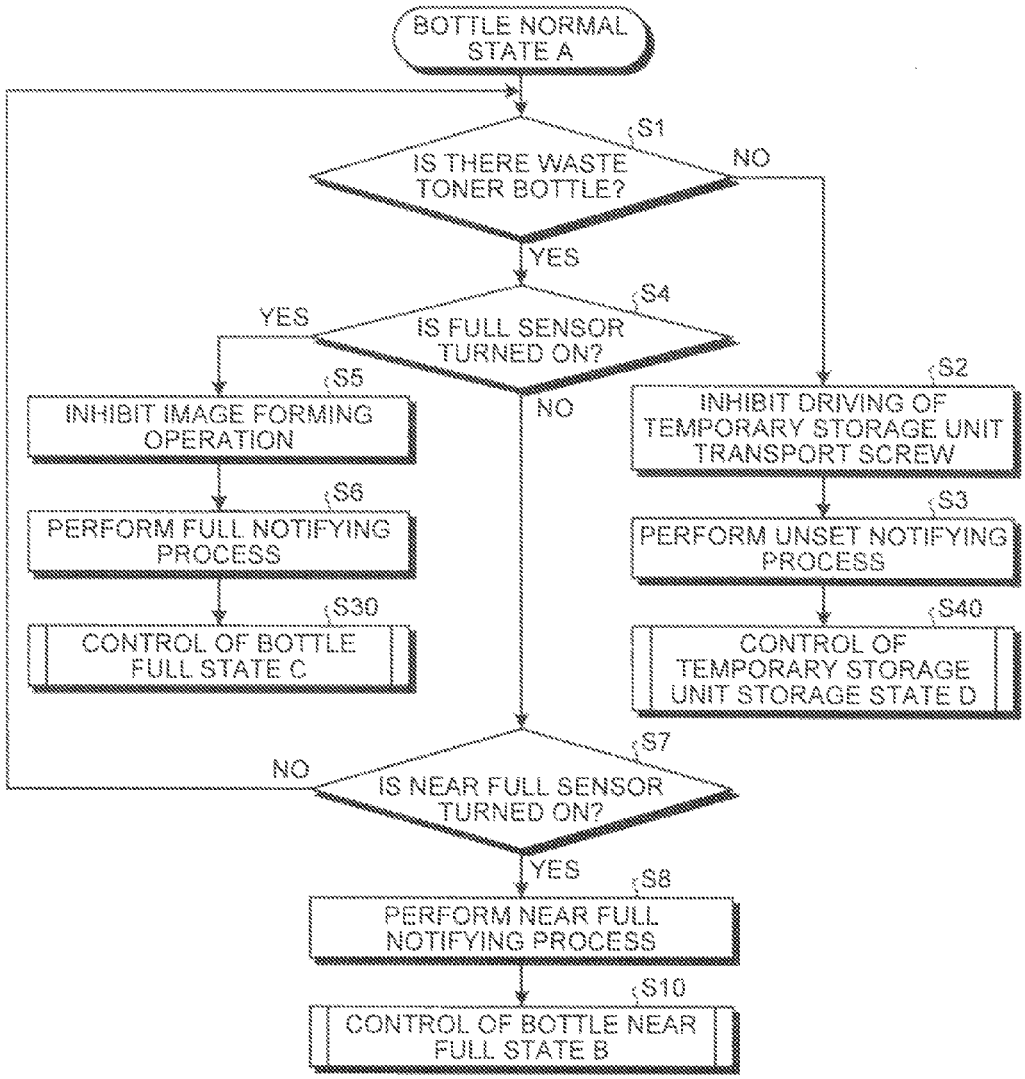
FIG. 5 is a flowchart illustrating the flow of control in a bottle normal state A.

FIG. 5 is a flowchart illustrating the flow of control when the image forming apparatus is in the bottle normal state A.

In the bottle normal state A, the detection signal of the set detection sensor 246 is constantly monitored and it is determined whether the image forming apparatus is in the bottle set state or the bottle unset state on the basis of the detection signal in Step S1. Specifically, the control unit 10 of the image forming apparatus body samples the detection signal of the set detection sensor 246 with a sampling period of 100 ms. When the same detection signal is acquired three times in a row, the control unit 10 detects that the image forming apparatus is in the state (the bottle unset state or the bottle set state) indicated by the detection signal. When it is determined that the image forming apparatus is in the bottle unset state (No in Step S1), first, the control unit 10 inhibits the driving of the temporary storage unit transport screw 244 in the waste toner transport path 243 for a temporary storage unit in Step S2. Then, the control unit 10 performs an unset notifying process of displaying a message indicating that the waste toner bottle 241 is removed on a display unit, such as an operation panel, to notify the user regarding the information in Step S3. Then, the process proceeds to the control of the temporary storage unit storage state D, which will be described below, without inhibiting the image forming operation in Step S40.

When it is determined that the image forming apparatus in the bottle set state (Yes in Step S1), first, the control unit 10 acquires the detection signal of the full sensor 247B and determines whether the waste toner bottle 241 is in the full state on the basis of the detection signal in Step S4. When it is determined that the waste toner bottle 241 is in the full state, the control unit 10 performs an image forming operation inhibition process in Step S5. The image forming operation inhibition process temporarily stops the image forming operation (print job) when an image is formed at the present moment (during a print job) and stops the operation of a driving system including the driving of the temporary storage unit transport screw 244. When an image is not formed at the present moment and a new image forming operation (print job) is received, the image forming operation inhibition process suspends the operation. Then, the control unit 10 performs a full notifying process of displaying a message indicating that the waste toner bottle 241 is full, the image forming operation is unavailable, and the user needs to replace the waste toner bottle 241 on the display unit, such as the operation panel, to notify the user of the information in Step S6. Then, the process proceeds to the control of the bottle full state C, which will be described below, in Step S30.

When it is determined that the waste toner bottle 241 is not in the full state (No in Step S4), the control unit 10 acquires the detection signal of the near full sensor 247A and determines whether the waste toner bottle 241 is in the near full state on the basis of the detection signal in Step S7. When it is determined that the waste toner bottle 241 is in the near full state, the control unit 10 performs a near full notifying process of displaying a message indicating that the waste toner bottle 241 is going to be full on the display unit, such as an operation panel, to notify the user of the information in Step S8. Then, the process proceeds to the control of the bottle near full state B (Step S10), which will be described below, without inhibiting the image forming operation. When it is determined that the waste toner bottle 241 is not in the near full state (No in Step S7), the process returns to Step S1.

Control of Bottle Near Full State B

Figure 6:
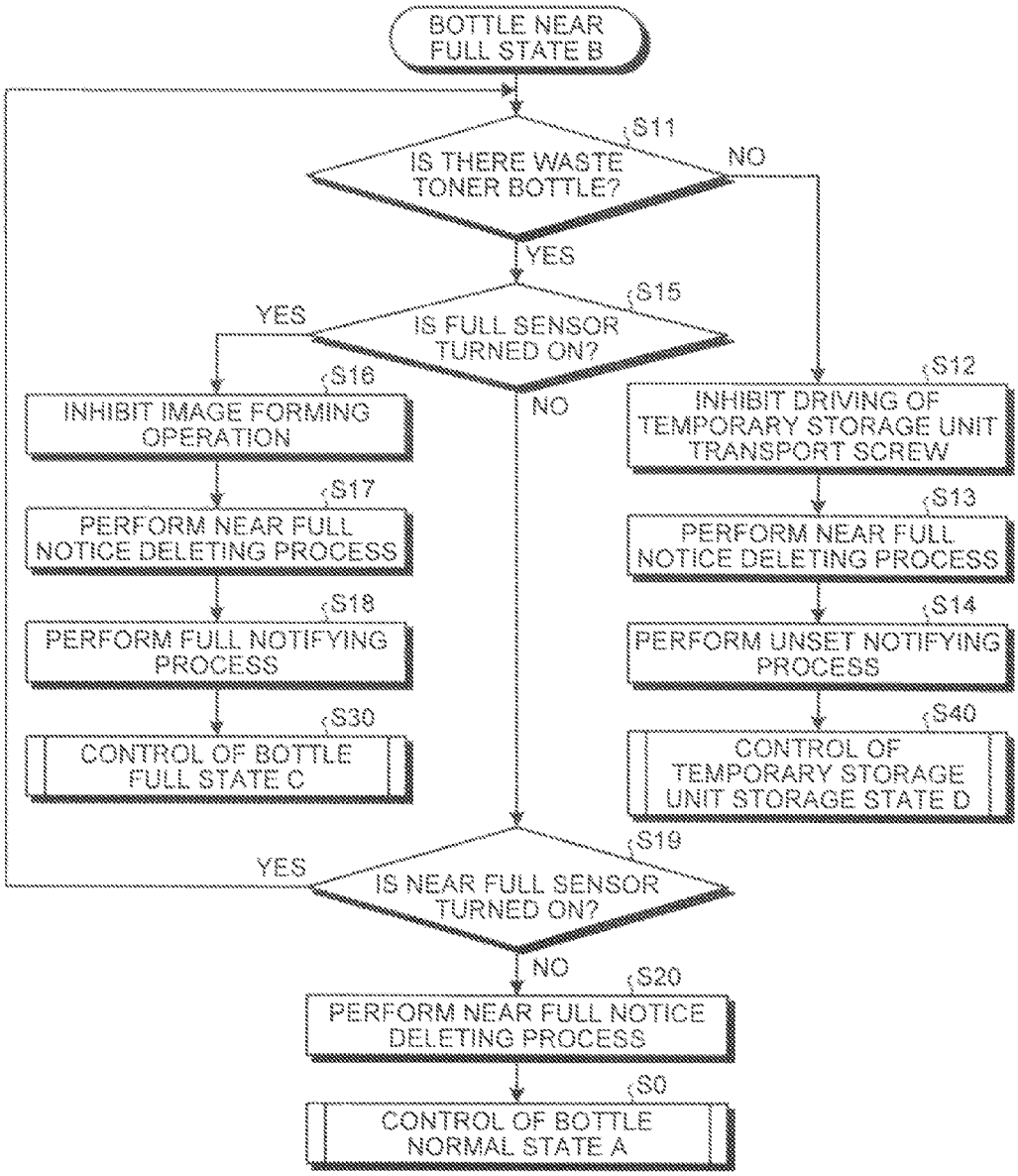
FIG. 6 is a flowchart illustrating the flow of control in a bottle near full state B.

FIG. 6 is a flowchart illustrating the flow of control when the image forming apparatus is in the bottle near full state B.

In the bottle near full state B, similarly to the bottle normal state A, the detection signal of the set detection sensor 246 is constantly monitored and it is determined whether the image forming apparatus is in the bottle set state or the bottle unset state on the basis of the detection signal in Step S11. When it is determined that the image forming apparatus is in the bottle unset state (No in Step S11), first, the control unit 10 inhibits the driving of the temporary storage unit transport screw 244 in the waste toner transport path 243 for a temporary storage unit in Step S12. Then, the control unit 10 deletes the content of the currently notified near full message in Step S13 and then performs the same unset notifying process as that in the bottle normal state A in Step S14. Then, the process proceeds to the control (Step S40) of the temporary storage unit storage state D, which will be described below, without inhibiting the image forming operation.

When it is determined that the image forming apparatus is in the bottle set state (Yes in Step S11), the control unit 10 acquires the detection signal of the full sensor 247B and determines whether the waste toner bottle 241 is in the full state on the basis of the detection signal in Step S15. When it is determined that the waste toner bottle 241 is in the full state, the control unit 10 performs the image forming operation inhibition process in Step S16 and performs a process of deleting the content of the currently notified near full message in Step S17. Then, the control unit 10 performs the full notifying process in Step S18. Then, the process proceeds to the control (Step S30) of the bottle full state C, which will be described below.

When it is determined that the waste toner bottle 241 is not in the full state (No in Step S15), the control unit 10 acquires the detection signal of the near full sensor 247A and determines whether the waste toner bottle 241 is in the near full state on the basis of the detection signal in Step S19. When it is determined that the waste toner bottle 241 is in the near full state (Yes in Step S19), the process returns to Step S11. On the other hand, when it is determined that the waste toner bottle 241 is not in the near full state (No in Step S19), the control unit 10 performs a process of deleting the content of the currently notified near full message in Step S20. Then, the process proceeds to the control of the bottle normal state A (Step S0).

Control of Bottle Full State C

Figure 7:
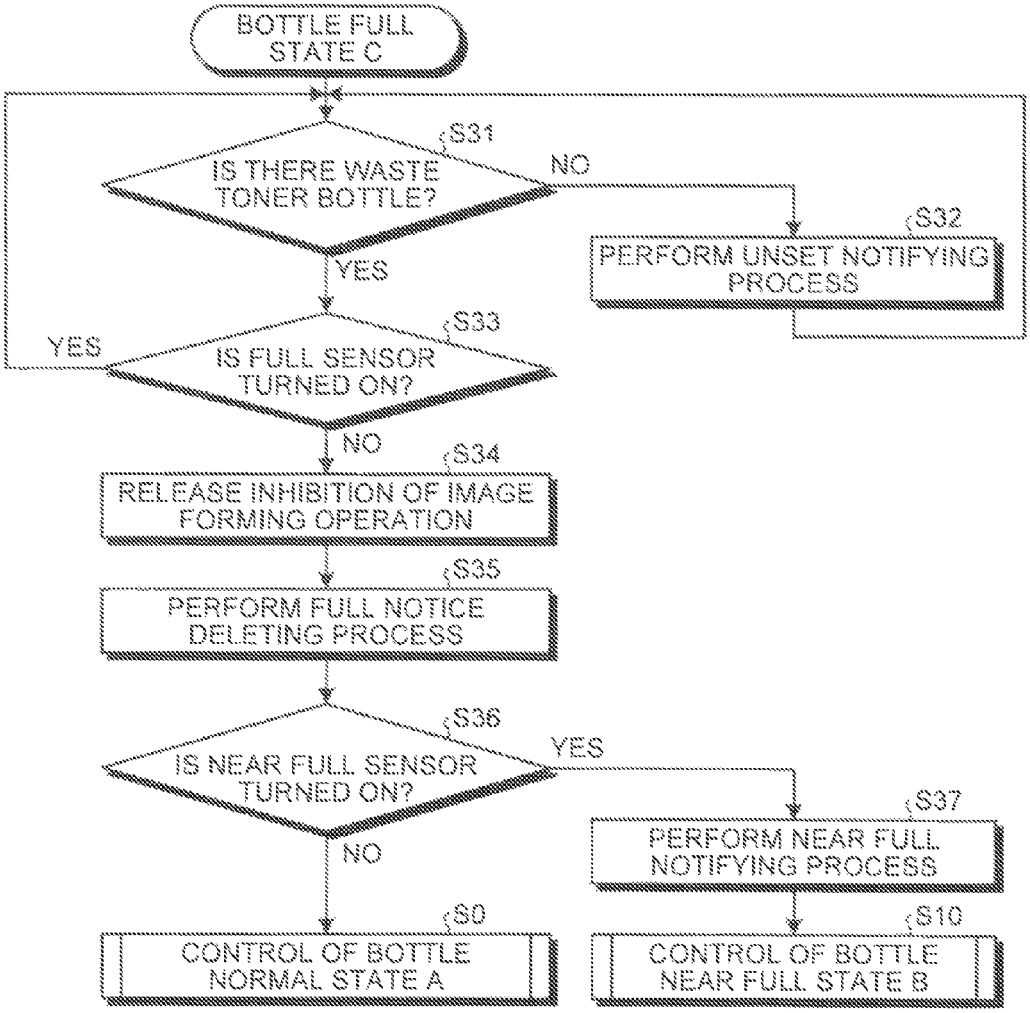
FIG. 7 is a flowchart illustrating the flow of control in a bottle full state C.

FIG. 7 is a flowchart illustrating the flow of control when the image forming apparatus is in the bottle full state C.

In the bottle full state C, similarly to the above, the detection signal of the set detection sensor 246 is constantly monitored and it is determined whether the image forming apparatus is in the bottle set state or the bottle unset state on the basis of the detection signal in Step S31. When it is determined that the image forming apparatus is in the bottle unset state (No in Step S31), the control unit 10 performs the unset notifying process in Step S32 and determines whether the waste toner bottle is set in Step S31. At this time, since the image forming operation has already been inhibited in Steps S5 and S16, the driving of the temporary storage unit transport screw 244 in the waste toner transport path 243 for a temporary storage unit is inhibited.

On the other hand, when it is determined that the image forming apparatus is in the bottle set state (Yes in Step S31), the control unit 10 acquires the detection signal of the full sensor 247B and determines whether the waste toner bottle 241 is in the full state on the basis of the detection signal in Step S33. When it is determined that the waste toner bottle 241 is in the full state, the control unit 10 monitors the detection signal of the set detection sensor 246 and determines whether the waste toner bottle is set in Step S31. When it is determined that the waste toner bottle 241 is not in the full state (No in Step S33), first, the control unit 10 releases the inhibition of the image forming operation in Step S34. In this way, when the image forming operation (print job) is temporarily stopped, the control unit 10 resumes the image forming operation. When a new image forming operation (print job) is suspended, the control unit 10 performs the image forming operation. Then, the control unit 10 performs a process of deleting the content of the currently notified full message in Step S35.

Then, the control unit 10 acquires the detection signal of the near full sensor 247A and determines whether the waste toner bottle 241 is in the near full state on the basis of the detection signal in Step S36. When it is determined that the waste toner bottle 241 is in the near full state, the control unit 10 performs a near full notifying process in Step S37 and the process proceeds to the control (Step S10) of the bottle near full state B. On the other hand, when it is determined that the waste toner bottle 241 is not in the near full state (No in Step S7), the process proceeds to the control (Step S0) of the bottle normal state A.

Control of Temporary Storage Unit Storage State D

Figure 8:
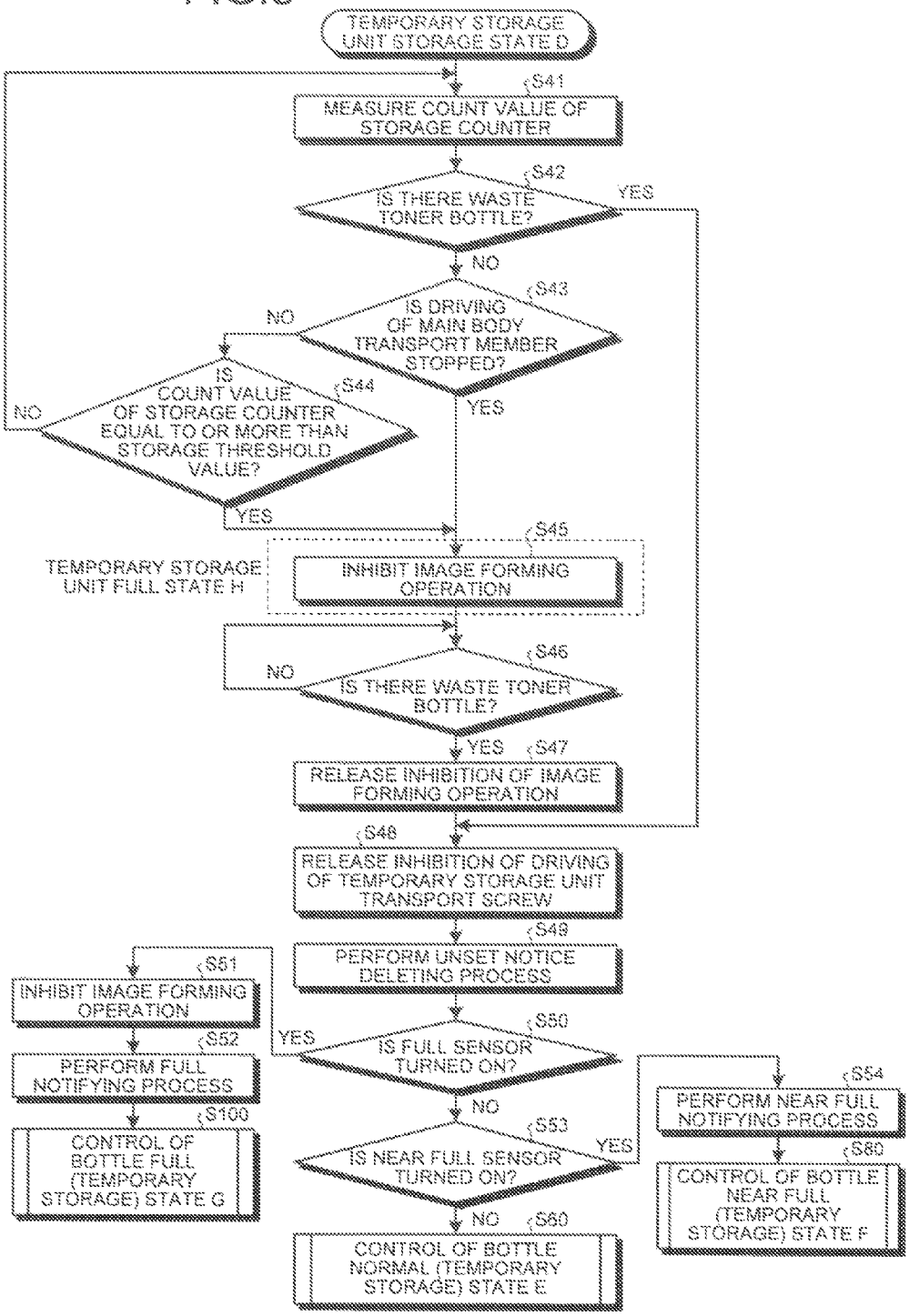
FIG. 8 is a flowchart illustrating the flow of control in a temporary storage unit storage state D.

FIG. 8 is a flowchart illustrating the flow of control when the image forming apparatus is in the temporary storage unit storage state D.

In the temporary storage unit storage state D, first, the control unit 10 starts the operation of a storage counter in Step S41. The storage counter counts the driving time of the main-body-side waste toner transport member as transport amount correlation information correlated with the amount of waste toner transported to the temporary storage unit 242 by the main-body-side waste toner transport member. The count value of the storage counter indicates the accumulated value of the driving time of the main-body-side waste toner transport member from the time when the waste toner bottle 241 is removed from the waste toner collecting unit 240 (the time when the bottle is removed). In this embodiment, when the count value of the storage counter reaches a predetermined storage threshold value in Step S44, it is estimated that the temporary storage unit 242 is full.

Since the amount of excess toner varies depending on, for example, a difference in the image forming mode (for example, whether the operation mode is the color mode or the monochrome mode or whether the operation mode is the toner consumption suppression mode or not) or a difference in the area ratio of a formed image, there is a little variation in the amount of waste toner transported to the waste toner transport path 210. Therefore, even when the main-body-side waste toner transport member is driven at the same transport speed, the amount of waste toner transported to the temporary storage unit 242 varies from hour to hour. The driving time of the main-body-side waste toner transport member is correlated with the amount of waste toner transported to the temporary storage unit 242 by the main-body-side waste toner transport member, but it is difficult to accurately know the estimated amount of waster toner transported to the temporary storage unit 242 after the bottle is removed, from the accumulated value of the driving time after the bottle is removed.

In the nonstop waste toner bottle replacement control according to this embodiment, even when the waste toner bottle 241 is removed, the waste toner is temporarily stored in the temporary storage unit 242. Therefore, at least during the replacement operation of the waste toner bottle 241, it is possible to continuously perform the image forming operation without stopping the image forming operation. After the replacement operation ends, it is possible to store the waste toner in a new waste toner bottle 241. Therefore, it is not necessary to temporarily store the waste toner in the temporary storage unit 242. The temporary storage unit 242 according to this embodiment has a volume capable of storing the amount of waste toner more than the maximum value of the amount of waste toner transported to the temporary storage unit 242 within the time required for the replacement operation. Therefore, it is not necessary to perform the image forming operation until the temporary storage unit 242 is full. As a result, it is not necessary to accurately know the estimated amount of waste toner transported to the temporary storage unit 242 after the bottle is removed. In the nonstop waste toner bottle replacement control according to this embodiment, it is important to reliably inhibit the image forming operation before the temporary storage unit 242 is full, thereby stopping the transport of waste toner to the temporary storage unit 242. In order to stop the transport operation, it is necessary to know the maximum amount of waste toner transported to the temporary storage unit 242 per unit time. It is possible to easily and accurately know the maximum transport amount of waste toner per unit time using, for example, experiments. Therefore, when the storage threshold value is determined from the maximum transport amount of waste toner per unit time, it is possible to reliably inhibit the image forming operation before the temporary storage unit 242 is full, thereby stopping the transport of the waste toner to the temporary storage unit 242.

As such, it is not necessary to accurately know the estimated amount of waste toner transported to the temporary storage unit 242 after the bottle is removed. Therefore, the transport amount correlation information is not limited to the driving time of the main-body-side waste toner transport member, but any other transport amount correlation information items may be used as long as they are correlated with the amount of waste toner transported to the temporary storage unit 242 by the main-body-side waste toner transport member. For example, image forming operation time (photosensitive element driving time) may be used. In particular, information collected for other purposes may be used as the transport amount correlation information.

When the estimated amount of waste toner transported to the temporary storage unit 242 after the bottle is removed is accurately detected and the image forming operation is performed until the temporary storage unit 242 is full, the transport amount correlation information may be corrected using the detection result (for example, the image forming mode and the image area ratio) of factors that change the amount of waste toner transported to the waste toner transport path 210.

In the temporary storage unit storage state D, first, the control unit 10 measures the value of the storage counter that measures the driving time of the main-body-side waste toner transport member which transports the waste toner in the waste toner transport path 210 provided in the image forming apparatus body to the temporary storage unit 242 in Step S41. Then, the control unit 10 determines whether the image forming apparatus is in the bottle unset state or the bottle set state on the basis of the detection signal of the set detection sensor 246 in Step S42. When it is determined that the image forming apparatus is in the bottle unset state (No in Step S42), the control unit 10 determines whether the driving of the main-body-side waste toner transport member is stopped in Step S43 and checks whether the image forming operation (print job) is currently performed. When it is determined that the driving of the main-body-side waste toner transport member is not stopped (No in Step S43), the control unit 10 determines whether the storage counter reaches the storage threshold value in Step S44. When it is determined that the storage counter does not reach the storage threshold value, the process returns to Step S41 and the control unit 10 measures the value of the storage counter again.

On the other hand, when it is determined that the storage counter reaches the storage threshold value (Yes in S44), the control unit 10 performs the image forming operation inhibition process in Step S45. In this case, the state in which the image forming operation is inhibited is the temporary storage unit full state H shown in FIG. 4. The image forming operation inhibition process is the same as the image forming operation inhibition process when it is determined that the waste toner bottle 241 is in the full state.

In this embodiment, when it is determined in Step S43 that the driving of the main-body-side waste toner transport member is stopped (Yes in S43), the image forming operation inhibition process (Step S45) is performed even though the storage counter does not reach the storage threshold value. That is, in this embodiment, in the case in which the image forming operation (print job) related to all image formation commands ends before the replacement of the waste toner bottle 241 is completed, even when the temporary storage unit 242 is not full, the image forming operation (print job) related to a new image formation command is inhibited until the waste toner bottle 241 is inserted and the replacement operation is completed. Of course, until the storage counter reaches the storage threshold value, the image forming operation (print job) related to a new image formation command may be performed.

When the image forming operation is inhibited before the waste toner bottle 241 is inserted and the image forming apparatus changes to the temporary storage unit full state H, the control unit 10 waits until it is determined that the image forming apparatus is in the bottle set state on the basis of the detection signal of the set detection sensor 246 in Step S46. Then, when it is determined that the image forming apparatus is in the bottle set state (Yes in Step S46), first, the control unit 10 releases the inhibition of the image forming operation in Step S47, which makes it possible to perform the next image forming operation. In addition, the control unit 10 releases the inhibition of the driving of the temporary storage unit transport screw 244 in Step S48. In this way, the waste toner in the temporary storage unit 242 is discharged to the newly set waste toner bottle 241 in synchronization with the next image forming operation. Then, the control unit 10 performs a process of deleting, for example, the content of the currently notified unset notification message in Step S49.

On the other hand, when a new waste toner bottle is inserted before the storage counter reaches the storage threshold value (Yes in Step S42), the control unit 10 releases the inhibition of the driving of the temporary storage unit transport screw 244 in Step S48 and performs a process of deleting, for example, the content of the currently notified unset notification message in Step S49. In this way, when the image forming operation is continuously performed while the waste toner is temporarily stored in the temporary storage unit 242 for the time from the removal of the waste toner bottle 241 to the insertion of a new waste toner bottle, the image forming operation is continuously performed.

However, when the newly set waste toner bottle 241 is in the full state (Yes in Step S50), the image forming operation inhibition process is performed in Step S51. Therefore, at that time, the image forming operation is stopped. In this case, the full notifying process is performed in Step S52 and the process proceeds to the control (Step S100) of the bottle full (temporary storage) state G, which will be described below.

When the waste toner bottle 241 is not in the full state, but is in the near full state (Yes in Step S53), the image forming operation is not inhibited and a near full notifying process is performed in Step S54. Then, the process proceeds to the control (Step S80) of the bottle near full (temporary storage) state F, which will be described below.

When it is determined that the waste toner bottle 241 is in neither the full state nor the near full state (No in Step S53), the process proceeds to the control (Step S60) of the bottle normal (temporary storage) state E, which will be described below.

Control of Bottle Normal (Temporary Storage) State E

Figure 9:
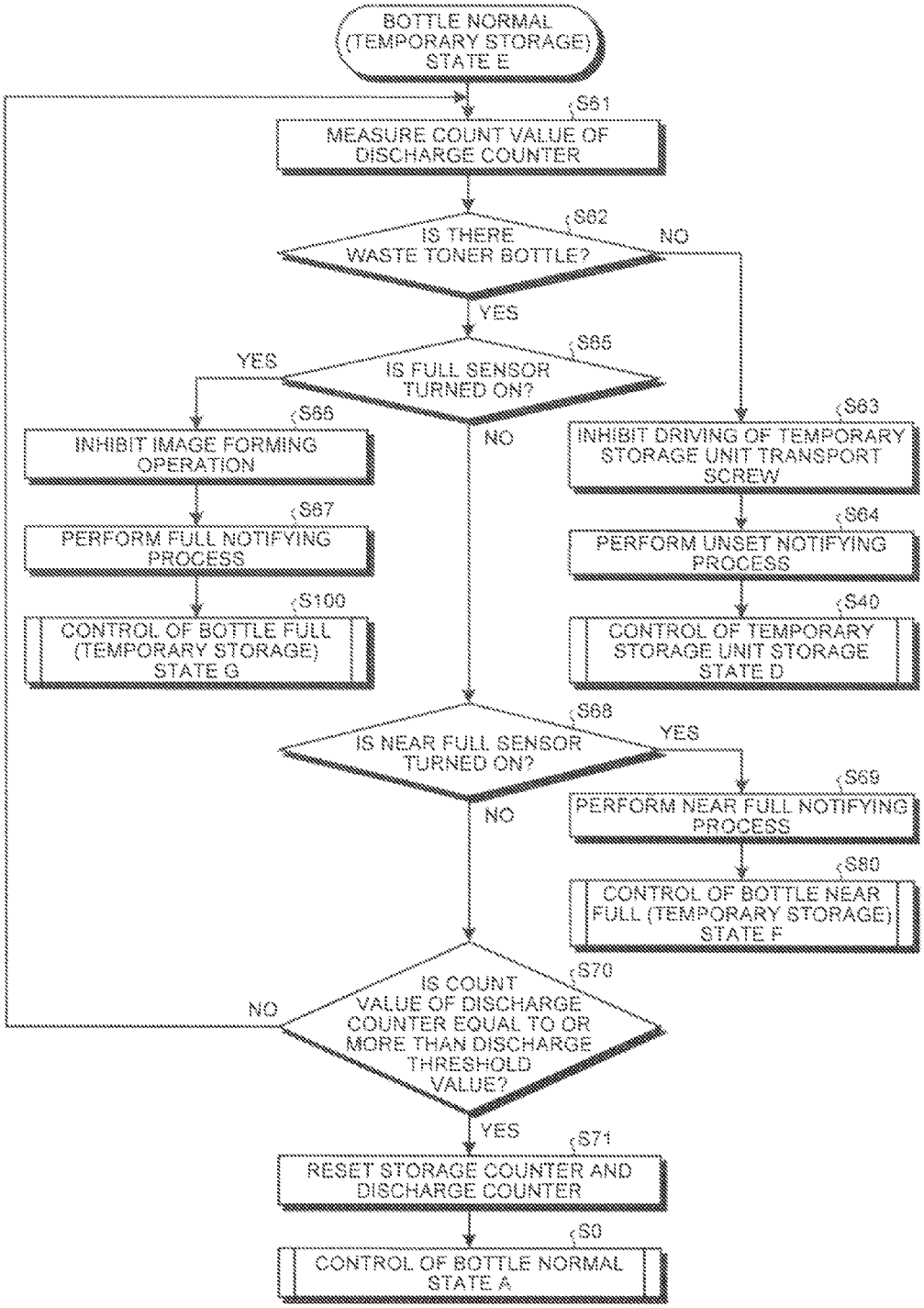
FIG. 9 is a flowchart illustrating the flow of control in a bottle normal (temporary storage) state E.

FIG. 9 is a flowchart illustrating the flow of control when the image forming apparatus is in the bottle normal (temporary storage) state E.

The bottle normal (temporary storage) state E is similar to the bottle normal state A in that the waste toner bottle 241 is set in the normal state, not in either the full state or the near full state. However, the bottle normal (temporary storage) state E is different from the bottle normal state A in that the waste toner which is temporarily stored in the temporary storage unit 242 after the waste toner bottle 241 is removed is not discharged from the temporary storage unit 242 and the temporary storage unit 242 is not in the empty state.

In the bottle normal (temporary storage) state E, first, the control unit 10 starts the operation of a discharge counter in Step S61. The discharge counter counts the driving time of the temporary storage unit transport screw 244 as discharge amount correlation information correlated with the amount of waste toner discharged from the temporary storage unit 242 by the temporary storage unit transport screw 244. The count value of the discharge counter is the accumulated value of the driving time of the temporary storage unit transport screw 244 from the time when the waste toner bottle 241 is inserted into the waste toner collecting unit 240 (the bottle is inserted). In this embodiment, when the count value of the discharge counter reaches a predetermined discharge threshold value (Yes in Step S70), it is determined that the temporary storage unit 242 is in the empty state and the image forming apparatus returns to the bottle normal state A.

While the temporary storage unit transport screw 244 is driven to discharge the waste toner from the temporary storage unit 242 to the waste toner bottle 241, the waste toner is transported to the temporary storage unit 242 by the main-body-side waste toner transport member in synchronization with the driving of the temporary storage unit transport screw 244. In this embodiment, as described above, the discharge speed of the waste toner from the temporary storage unit 242 by the temporary storage unit transport screw 244 is higher than the transport speed of the waste toner to the temporary storage unit 242 by the main-body-side waste toner transport member. Therefore, when the driving time of the temporary storage unit transport screw 244 increases, the amount of waste toner in the temporary storage unit 242 is reduced by a value corresponding to the difference between the transport speeds.

In this case, since the amount of waste toner transported to the temporary storage unit 242 varies from hour to hour depending on, for example, a difference in the image forming mode or a difference in the area ratio of an image, it is difficult to accurately know the estimated reduced amount of waste toner in the temporary storage unit 242 after the bottle is inserted from the accumulated value of the driving time of the temporary storage unit transport screw 244 from the insertion of the bottle. However, in this embodiment, the reason why it is determined whether the temporary storage unit 242 is in the empty state is as follows. That is, in this embodiment in which a sensor for detecting whether the temporary storage unit 242 is full is not provided, when the waste toner bottle 241 is removed before the temporary storage unit 242 becomes the empty state after the replacement of the waste toner bottle 241, it is difficult to accurately know the amount of waste toner in the temporary storage unit 242. Therefore, it is difficult to accurately detect whether the temporary storage unit 242 is full on the basis of the count value of the storage counter. As a result, it is difficult to inhibit the image forming operation (change to the temporary storage unit full state H) before the temporary storage unit 242 is full. Meanwhile, after the temporary storage unit 242 becomes the empty state, as described above, it is possible to accurately detect whether the temporary storage unit 242 is full on the basis of the count value of the storage counter. Therefore, it is possible to inhibit the image forming operation before the temporary storage unit 242 is full. For this reason, in this embodiment, it is determined whether the temporary storage unit 242 is in the empty state. Therefore, it is important to inhibit the image forming operation before the temporary storage unit 242 is full. It is not necessary to accurately know when the temporary storage unit 242 becomes the empty state, and it is preferable to accurately determine whether the temporary storage unit 242 is in the empty state. In order to perform the accurate determination, it is not necessary to accurately know the estimated reduced amount of waste toner after the bottle is inserted, and it is important to know the minimum reduced amount of waste toner in the temporary storage unit 242 per unit time. The reduction rate can be easily and accurately calculated by, for example, experiments. Therefore, in the case in which the discharge threshold value is determined from the minimum reduced amount of waste toner per unit time, it is possible to reliably prevent an error (it is difficult to inhibit the image forming operation before the temporary storage unit 242 is full) due to an operation of determining whether the temporary storage unit 242 is in the full state on the condition that the temporary storage unit 242 is in the empty state when the waste toner bottle 241 is removed before the temporary storage unit 242 is empty.

As such, it is not necessary to accurately know the estimated reduced amount of waste toner in the temporary storage unit 242 after the bottle is inserted. Therefore, any other information may be used as the transport amount correlation information or the discharge amount correlation information for determining the estimated reduced amount of waste toner after the bottle is inserted as long as it has a predetermined correlation. In particular, information collected for other purposes may be used as the transport amount correlation information or the discharge amount correlation information.

In order to further improve the accuracy of calculating the estimated reduced amount of waste toner in the temporary storage unit 242 after the bottle is inserted, the transport amount correlation information or the discharge amount correlation information may be corrected on the basis of the detection result (for example, the image forming mode and the image area ratio) of factors changing the reduced amount of waste toner in the temporary storage unit 242.

In the bottle normal (temporary storage) state E, first, the control unit 10 measures the value of the discharge counter for measuring the driving time of the temporary storage unit transport screw 244 which transports the waste toner in the temporary storage unit 242 to the waste toner bottle 241 in Step S61. Then, the control unit 10 determines whether the image forming apparatus is in the bottle unset state or the bottle set state on the basis of the detection signal of the set detection sensor 246 in Step S62. When it is determined that the image forming apparatus is in the bottle unset state (No in Step S62), the control unit 10 inhibits the driving of the temporary storage unit transport screw 244 in the waste toner transport path 243 for a temporary storage unit in Step S63. Then, the control unit 10 performs the unset notifying process in Step S64 and the process proceeds to the control (Step S40) of the temporary storage unit storage state D, which will be described below. In this case, since the storage counter has reached the storage threshold value, the image forming operation is inhibited by the determination result in Step S44 immediately after the process proceeds to the control (Step S40) of the temporary storage unit storage state D and the image forming apparatus changes to the temporary storage unit full state H in Step S45.

On the other hand, when it is determined that the image forming apparatus is in the bottle set state (Yes in Step S62), the control unit 10 acquires the detection signal of the full sensor 247B and determines whether the waste toner bottle 241 is in a full state on the basis of the detection signal in Step S65. When it is determined that the waste toner bottle 241 is in the full state (Yes in Step S65), the control unit 10 performs the image forming operation inhibition process in Step S66 and then performs the full notifying process in Step S67. Then, the process proceeds to the control (Step S100) of the bottle full (temporary storage) state G, which will be described below.

When it is determined that the waste toner bottle 241 is not in the full state (No in Step S65), the control unit 10 acquires the detection signal of the near full sensor 247A and determines whether the waste toner bottle 241 is a near full state on the basis of the detection signal in Step S68. When it is determined that the waste toner bottle 241 is in the near full state (Yes in Step S68), the control unit 10 performs the near full notifying process in Step S69 and the process proceeds to the control (Step S80) of the bottle near full (temporary storage) state F, which will be described below, without inhibiting the image forming operation.

When it is determined that the waste toner bottle 241 is not in the near full state (No in Step S68), the control unit 10 determines whether the discharge counter reaches the discharge threshold value in Step S70. When it is determined that the discharge counter does not reach the discharge threshold value (No in Step S70), the process returns to Step S61 and the control unit 10 measures the value of the discharge counter again. On the other hand, when it is determined that the discharge counter reaches the discharge threshold value (Yes in Step S70), the control unit 10 resets the storage counter and the discharge counter in Step S71 and the process proceeds to the control (Step S0) of the bottle normal state A.

Control of Bottle Near Full (Temporary Storage) State F

Figure 10:
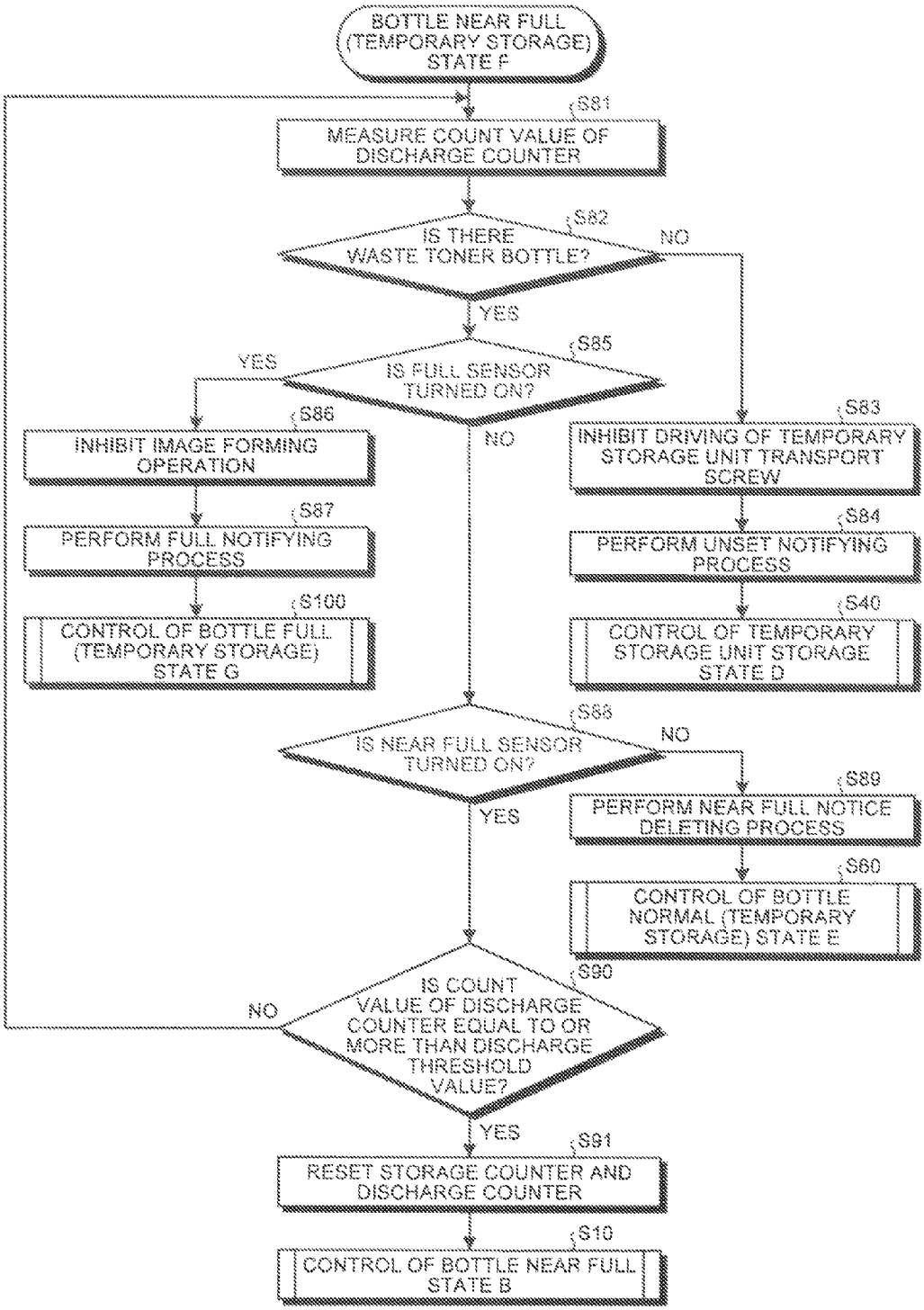
FIG. 10 is a flowchart illustrating the flow of control in a bottle near full (temporary storage) state F.

FIG. 10 is a flowchart illustrating the flow of control when the image forming apparatus is in the bottle near full (temporary storage) state F.

In the bottle near full state B, similarly to the bottle normal state A, the control unit 10 measures the value of the discharge counter in Step S81 and determines whether the image forming apparatus is in the bottle unset state or the bottle set state on the basis of the detection signal of the set detection sensor 246 in Step S82. When it is determined that the image forming apparatus is in the bottle unset state (No in Step S82), the control unit 10 inhibits the driving of the temporary storage unit transport screw 244 in the waste toner transport path 243 for a temporary storage unit in Step S83. Then, the control unit 10 performs the unset notifying process in Step S84 and the process proceeds to the control (Step S40) of the temporary storage unit storage state D, which will be described below. In this case, since the storage counter has reached the storage threshold value, the image forming operation is inhibited by the determination result in Step S44 immediately after the process proceeds to the control (Step S40) of the temporary storage unit storage state D and the image forming apparatus changes to the temporary storage unit full state H in Step S45.

On the other hand, when it is determined that the image forming apparatus is in the bottle set state (Yes in Step S82), the control unit 10 determines whether the waste toner bottle 241 is in a full state on the basis of the detection signal of the full sensor 247B in Step S85. When it is determined that the waste toner bottle 241 is in the full state (Yes in Step S85), the control unit 10 performs the image forming operation inhibition process in Step S86 and then performs the full notifying process in Step S87. Then, the process proceeds to the control (Step S100) of the bottle full (temporary storage) state G, which will be described below.

When it is determined that the waste toner bottle 241 is not in the full state (No in Step S85), the control unit 10 determines whether the waste toner bottle 241 is a near full state on the basis of the detection signal of the near full sensor 247A in Step S88. When it is determined that the waste toner bottle 241 is not in the near full state (No in Step S88), the control unit 10 performs a process of deleting, for example, the content of the currently notified near full message in Step S89 and the process proceeds to the control (S60) of the bottle normal (temporary storage) state E. In this way, finally, when the count value of the discharge counter reaches the discharge threshold value (Yes in Step S70), the storage counter and the discharge counter are reset in Step S71. Then, the process proceeds to the control (Step S0) of the bottle normal state A.

When it is determined that the waste toner bottle 241 is in the near full state (Yes in Step S88), the control unit 10 determines whether the discharge counter reaches the discharge threshold value in Step S90. When it is determined that the discharge counter does not reach the discharge threshold value (No in Step S90), the process returns to Step S81 and the control unit 10 measures the value of the discharge counter again. On the other hand, when it is determined that the discharge counter reaches the discharge threshold value (Yes in Step S90), the control unit 10 resets the storage counter and the discharge counter in Step S91 and the process proceeds to the control (Step S10) of the bottle near full state B.

Control of Bottle Full (Temporary Storage) State G

Figure 11:
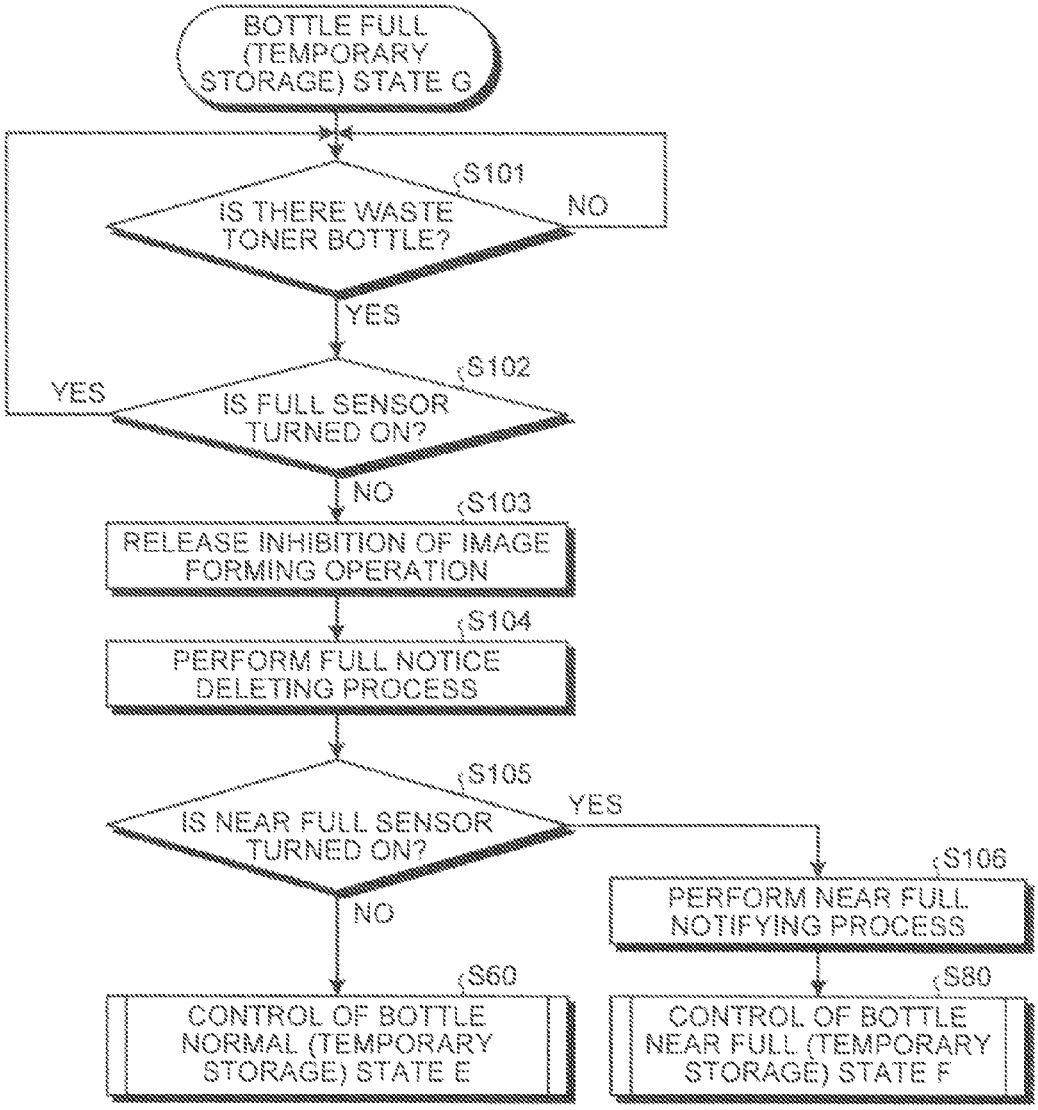
FIG. 11 is a flowchart illustrating the flow of control in a bottle full (temporary storage) state G.

FIG. 11 is a flowchart illustrating the flow of control when the image forming apparatus is in the bottle full (temporary storage) state G.

In the bottle full (temporary storage) state G, the image forming operation is inhibited and the driving system, such as the temporary storage unit transport screw 244 or the main-body-side waste toner transport member, is stopped. Therefore, the control unit 10 does not measure the value of the discharge counter. The control unit 10 waits until it is determined that the image forming apparatus is in the bottle set state on the basis of the detection signal of the set detection sensor 246 (No in Step S101) and it is determined that the waste toner bottle 241 is not in the full state on the basis of the detection signal of the full sensor 247B (No in Step S102). When a waste toner bottle which is not in a full state is inserted, it is determined that the image forming apparatus is in the bottle set state (Yes in Step S101) and the waste toner bottle 241 is not in the full state (No in Step S102). Then, the inhibition of the image forming operation is released in Step S103. Then, the control unit 10 performs a process of deleting, for example, the content of the currently notified full message in Step S104.

Then, the control unit 10 determines whether the waste toner bottle 241 is in a near full state on the basis of the detection signal of the near full sensor 247A in Step S105. When it is determined that the waste toner bottle 241 is in the near full state, the control unit 10 performs the near full notifying process in Step S106 and the process proceeds to the control (Step S80) of the bottle near full (temporary storage) state F. In this way, finally, when the count number of the discharge counter reaches the discharge threshold value (Yes in Step S90), the storage counter and the discharge counter are reset in Step S91. Then, the process proceeds to the control (Step S10) of the bottle near full state B.

On the other hand, when it is determined that the waste toner bottle 241 is not in the near full state (No in Step S105), the process proceeds to the control (Step S60) of the bottle normal (temporary storage) state E. In this way, finally, when the count value of the discharge counter reaches the discharge threshold value (Yes in Step S70), the storage counter and the discharge counter are reset in Step S71. Then, the process proceeds to the control (Step S0) of the bottle normal state A.

Next, control related to the replacement of the waste toner bottle when power is turned on will be described.

Figure 12:
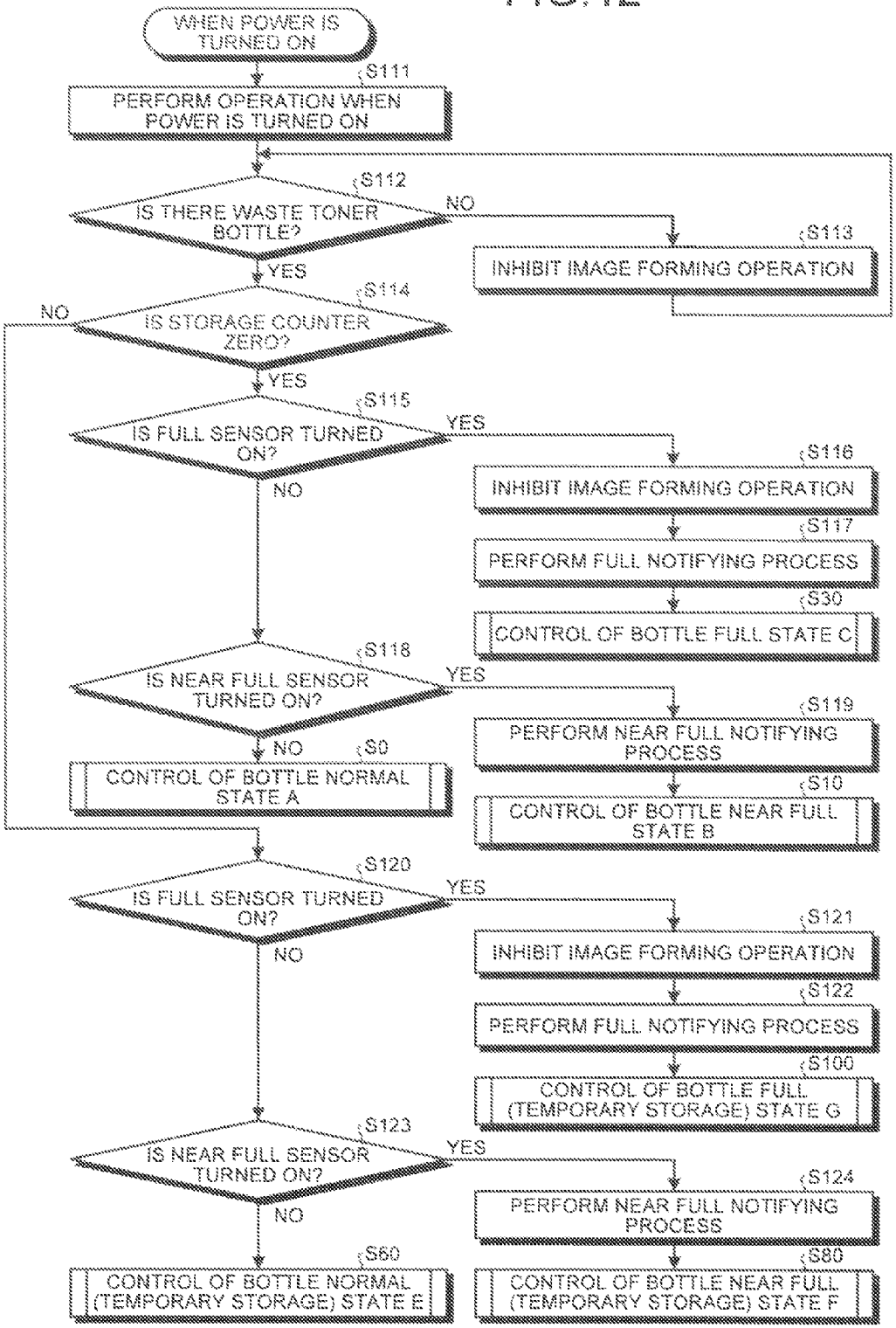

FIG. 12 is a flowchart illustrating the flow of the control related to the replacement of the waste toner bottle when power is turned on.

When power is turned on, a normal power-on operation is performed in Step S111. The power-on operation checks whether a door of the image forming apparatus body which is opened or closed when the waste toner bottle 241 is inserted or removed is opened or closed, thereby checking whether an image forming operation is available. In particular, the control unit 10 determines whether the waste toner bottle is set on the basis of the detection signal of the set detection sensor 246 in Step S112. The control unit 10 inhibits the image forming operation until the waste toner bottle is set in Step S113.

When it is determined that the image forming apparatus is in the bottle set state (Yes in Step S112), the control unit 10 determines whether the count value of the storage counter is zero in Step S114. When the count value of the storage counter is zero, the temporary storage unit 242 is empty. When it is determined that the waste toner bottle 241 is in the full state on the basis of the detection signal of the full sensor 247B (Yes in Step S115), the control unit 10 performs the image forming operation inhibition process in Step S116 and performs the full notifying process in Step S117. Then, the process proceeds to the control (Step S30) of the bottle full state C. When it is determined that the waste toner bottle 241 is in the near full state on the basis of the detection signal of the near full sensor 247A (Yes in Step S118), the control unit 10 performs the near full notifying process without inhibiting the image forming operation in Step S119. Then, the process proceeds to the control (Step S10) of the bottle near full state B. When it is determined that the waste toner bottle 241 is in the normal state, not in either the full state or the near full state (No in Step S118), the process proceeds to the control (Step S0) of the bottle normal state A.

When the count value of the storage counter is not zero (No in Step S114), the temporary storage unit 242 is not empty. Therefore, when it is determined that the waste toner bottle 241 is in the full state (Yes in Step S120), the control unit 10 performs the image forming operation inhibition process in Step S121 and performs the full notifying process in Step S122. Then, the process proceeds to the control (Step S100) of the bottle full (temporary storage) state G. When it is determined that the waste toner bottle 241 is in the near full state (Yes in Step S123), the control unit 10 performs the near full notifying process without inhibiting the image forming operation in Step S124. Then, the process proceeds to the control (Step S80) of the bottle near full (temporary storage) state F. When it is determined that the waste toner bottle 241 is in the normal state, not in either the full state or the near full state (No in Step S123), the process proceeds to the control (Step S60) of the bottle normal (temporary storage) state E.

In this embodiment, since the count value of the storage counter is stored in a non-volatile memory capable of storing data even when power is turned off, the above-mentioned control operation can be performed. However, when the count value of the storage counter is stored in a volatile memory which cannot store data when power is turned off, the control unit 10 may perform control such that the temporary storage unit 242 is not in an empty state. In this case, in the flowchart shown in FIG. 12, it may be determined that the count value of the storage counter is always not zero (No in Step S114).

Modifications

Next, modifications of the nonstop waste toner bottle replacement control according to the above-described embodiment will be described.

Figure 13:
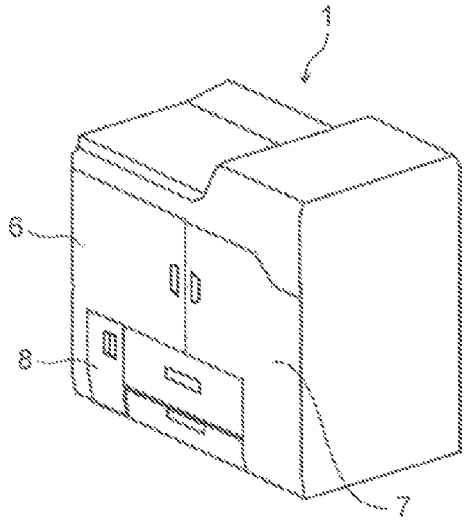
FIG. 13 is a perspective view schematically illustrating the outward appearance of an image forming apparatus according to a modification.

FIG. 13 is a perspective view schematically illustrating the outward appearance of an image forming apparatus according to this modification.

Figure 14:
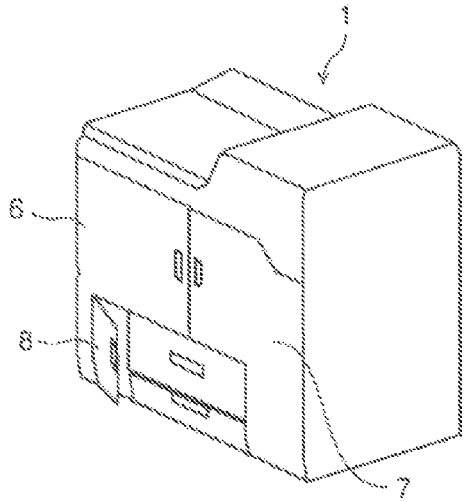
FIG. 14 is a perspective view illustrating the opened state of a door only for a waste toner bottle of the image forming apparatus.

FIG. 14 is a perspective view illustrating the opened state of a door 8 only for a waste toner bottle.

Figure 15:
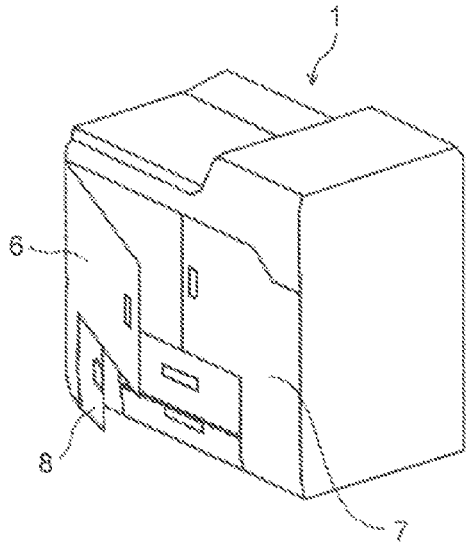
FIG. 15 is a perspective view illustrating the opened state of a front door of the image forming apparatus.
Figure 16:
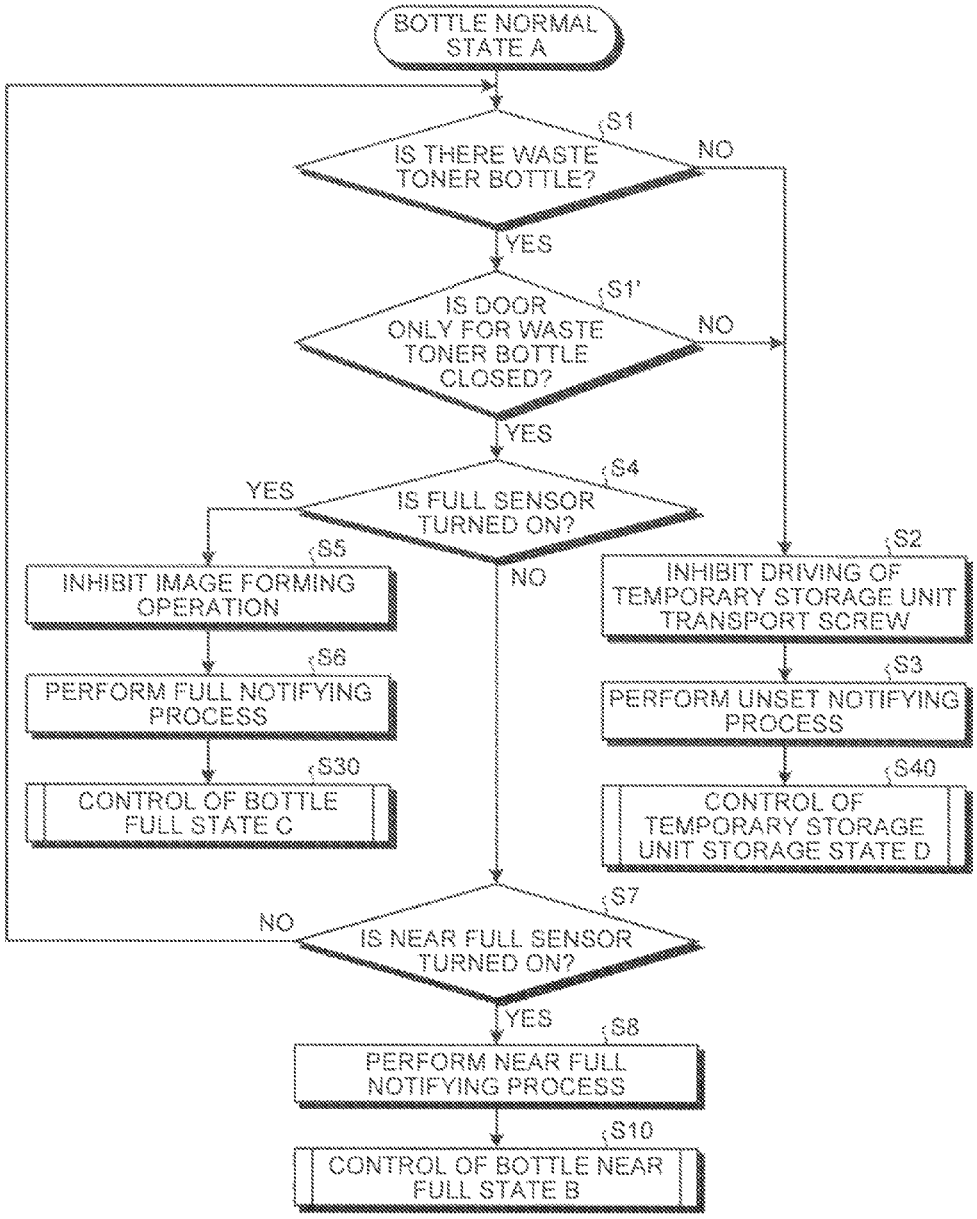
FIG. 16 is a flowchart illustrating the flow of control in the bottle normal state A in the modification.
Figure 17:
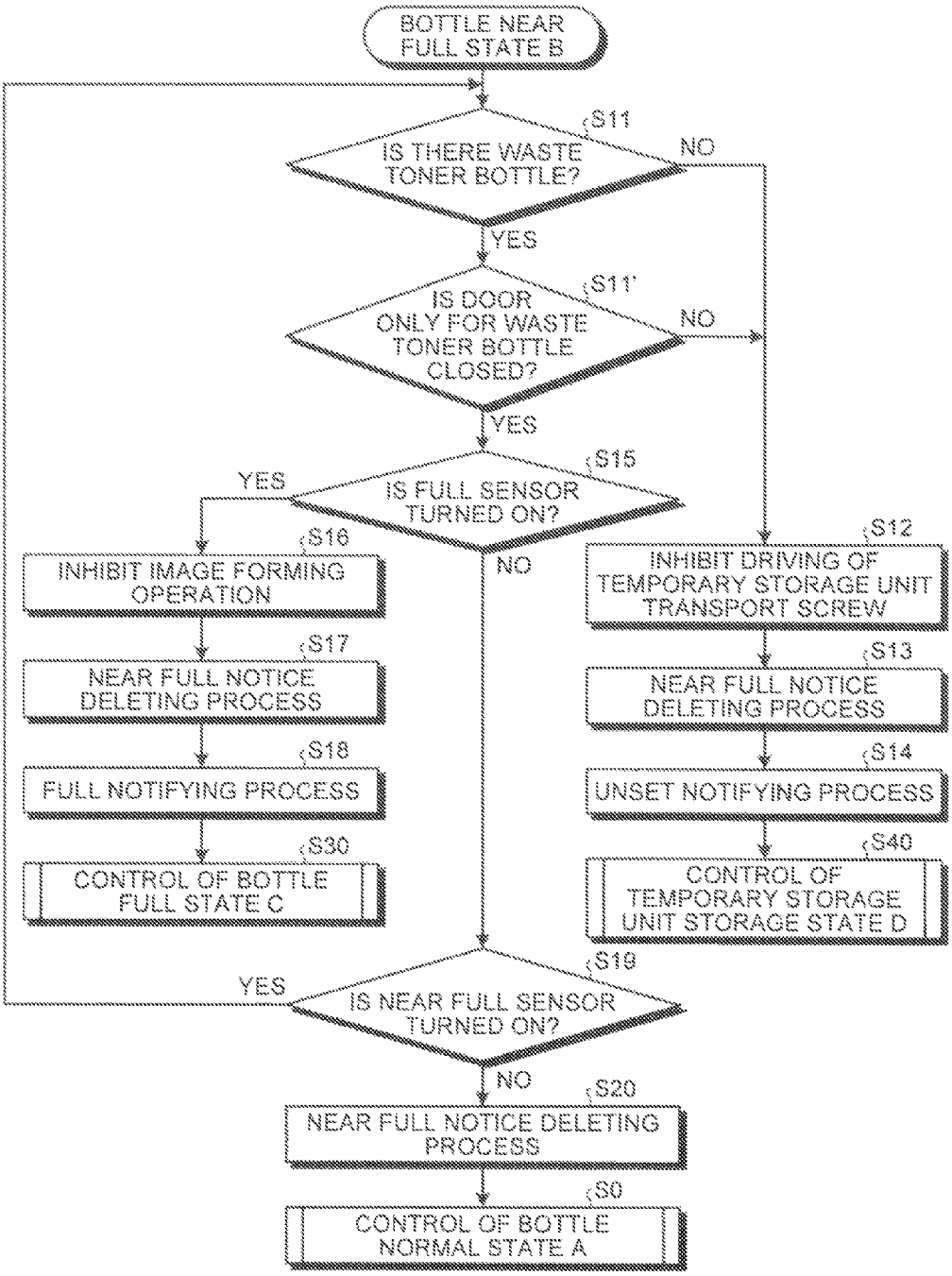
FIG. 17 is a flowchart illustrating the flow of control in the bottle near full state B in the modification.
Figure 18:
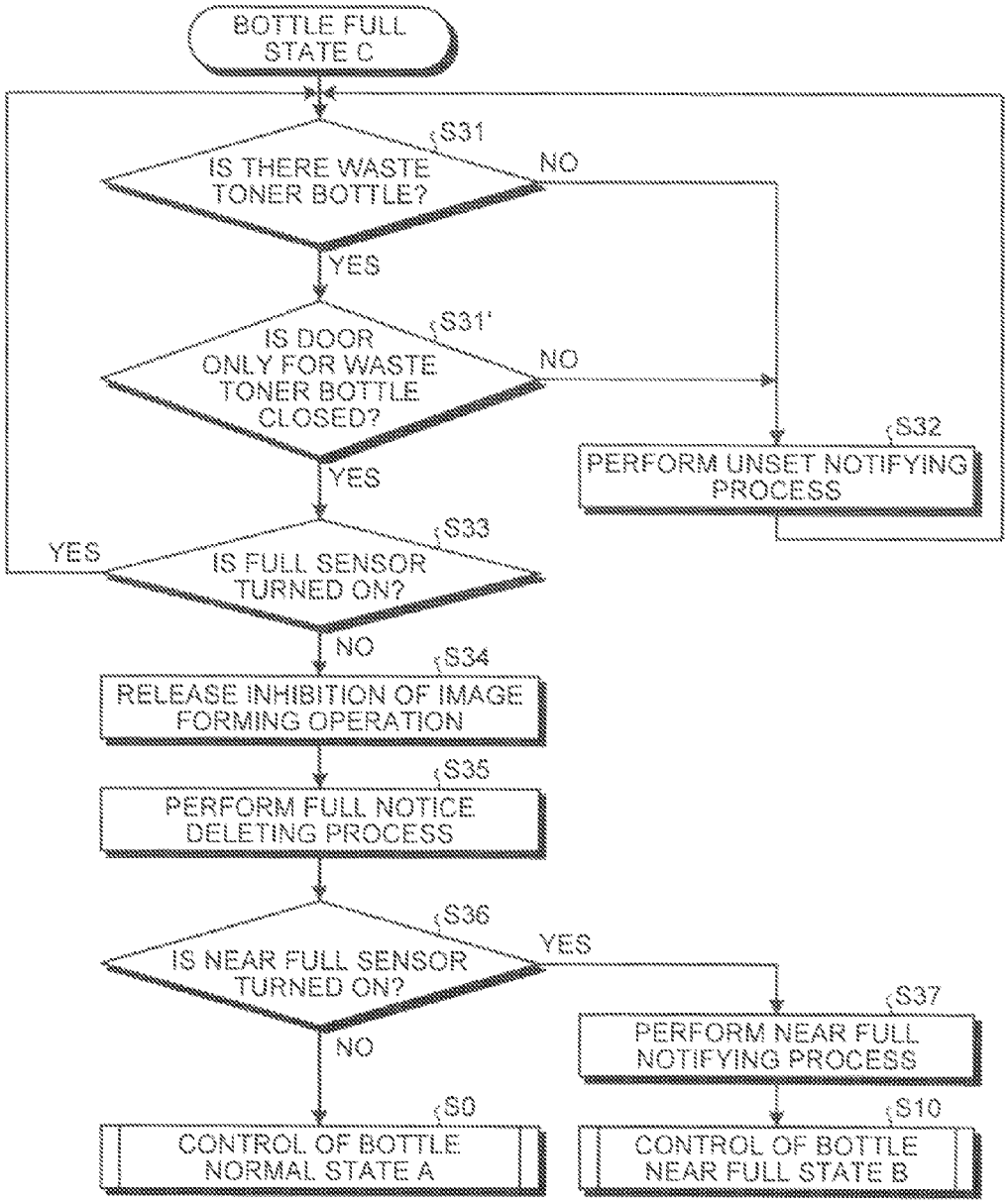
FIG. 18 is a flowchart illustrating the flow of control in the bottle full state C in the modification.
Figure 19:
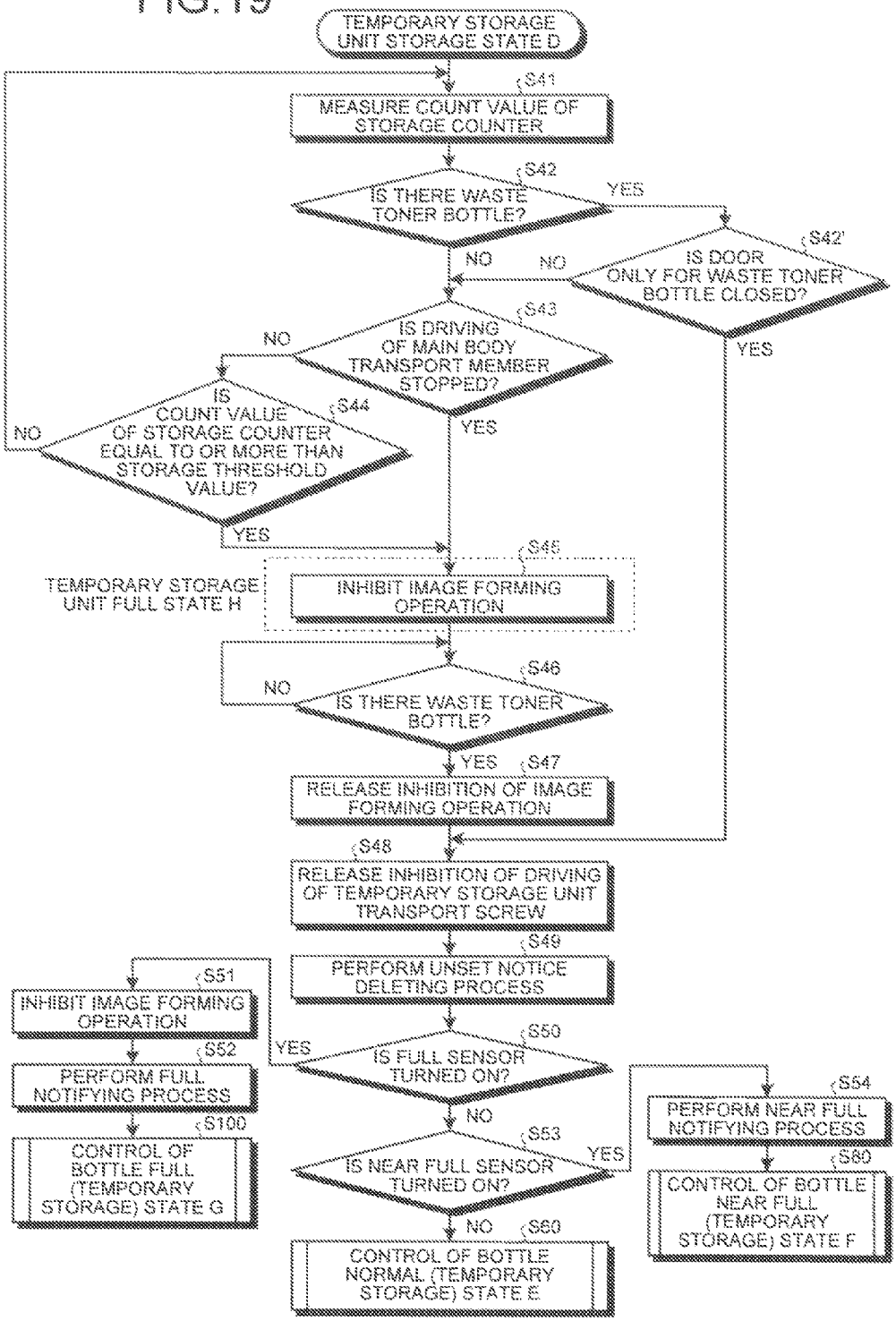
FIG. 19 is a flowchart illustrating the flow of control in the temporary storage unit storage state D in the modification.
Figure 20:
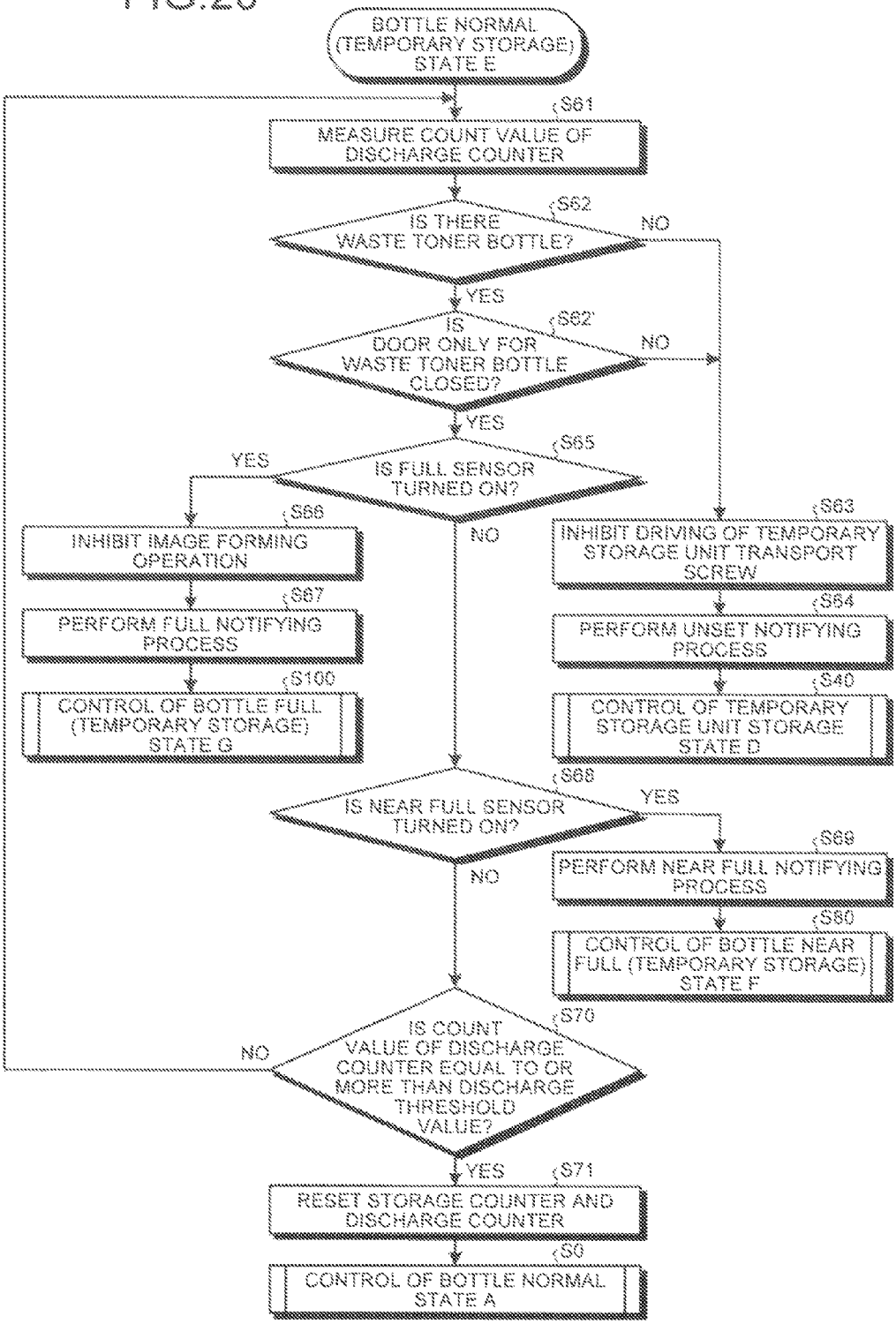
FIG. 20 is a flowchart illustrating the flow of control in the bottle normal (temporary storage) state E in the modification.
Figure 21:
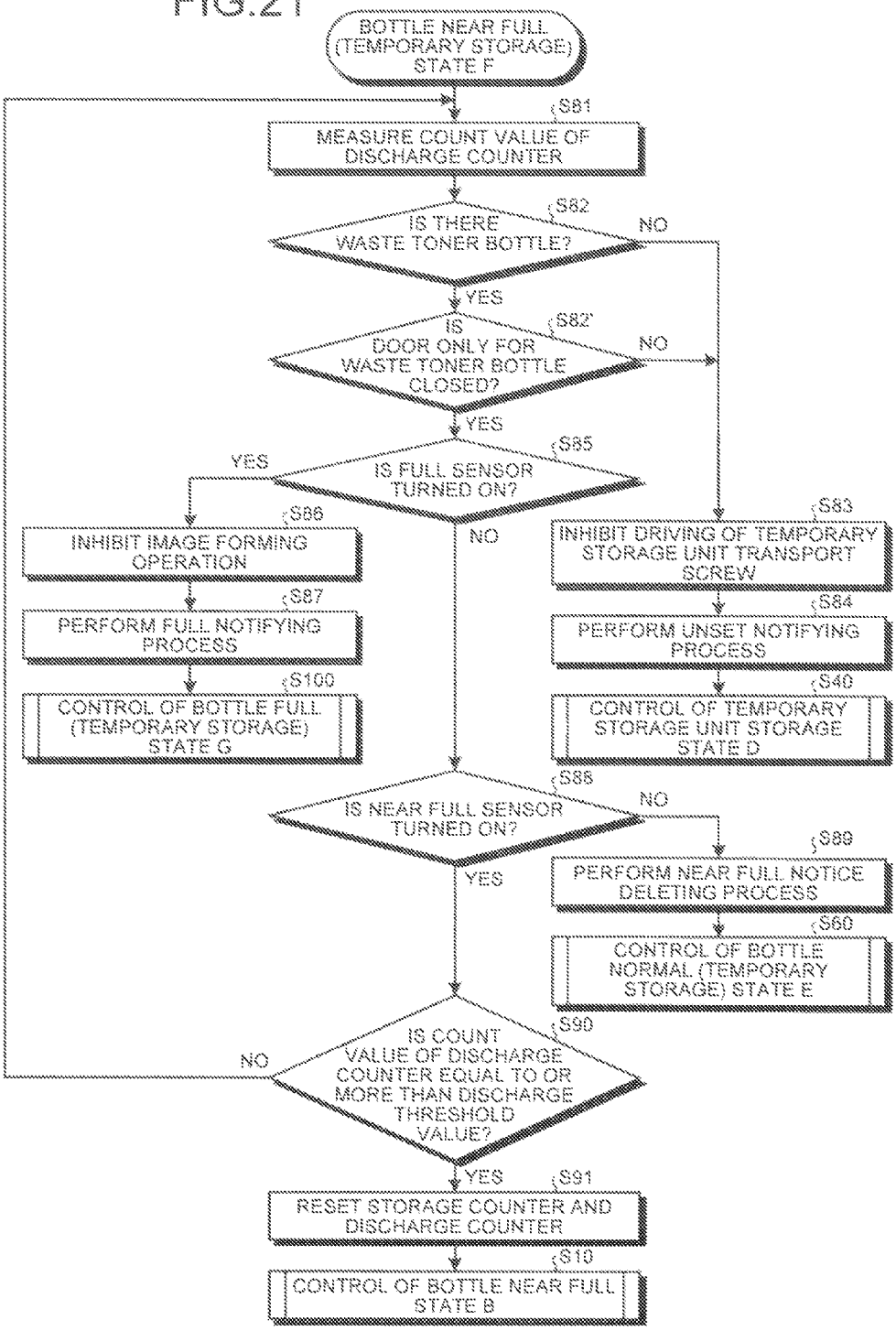
FIG. 21 is a flowchart illustrating the flow of control in the bottle near full (temporary storage) state F in the modification.
Figure 22:
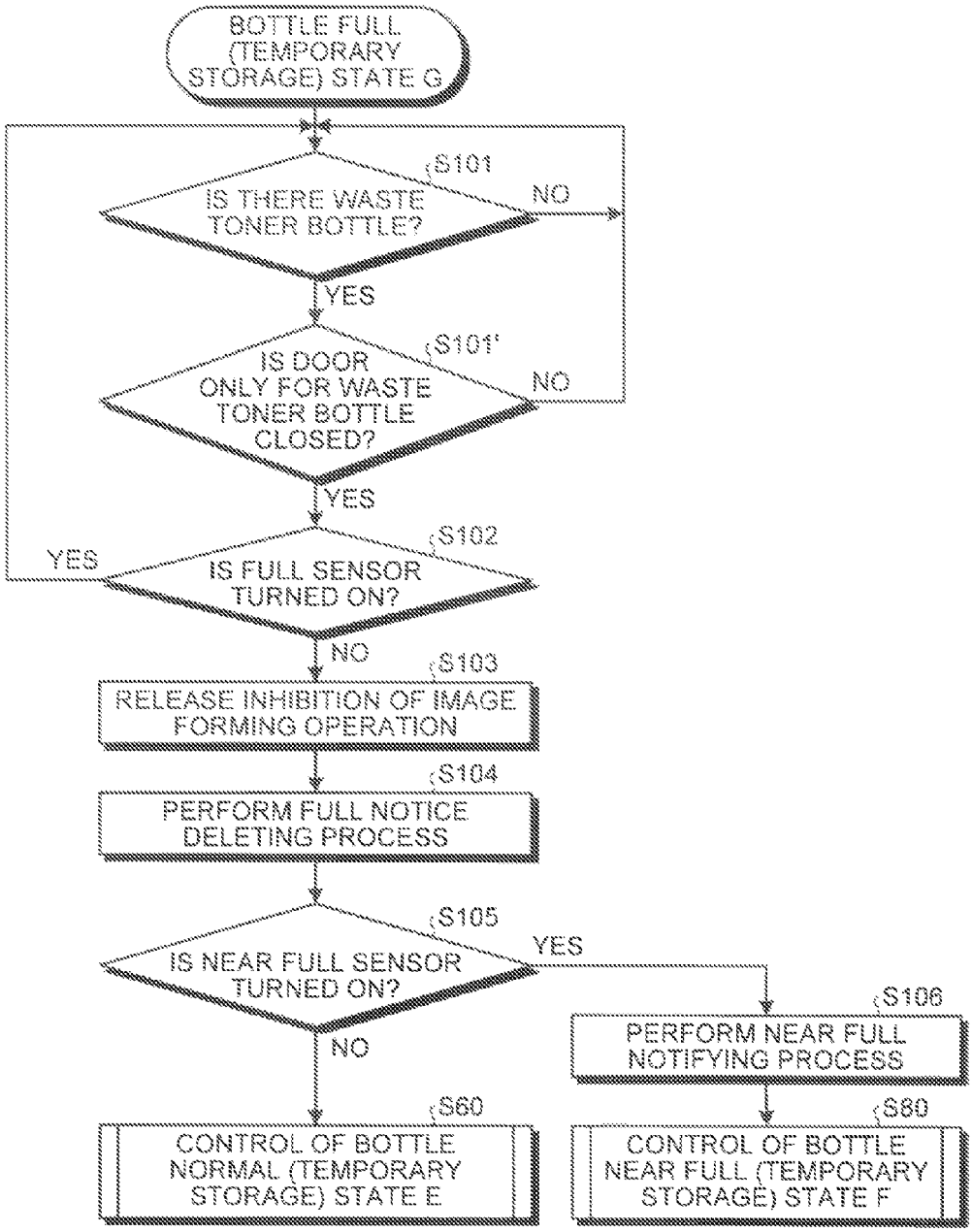
FIG. 22 is a flowchart illustrating the flow of control in the bottle full (temporary storage) state G in the modification.
Figure 23:
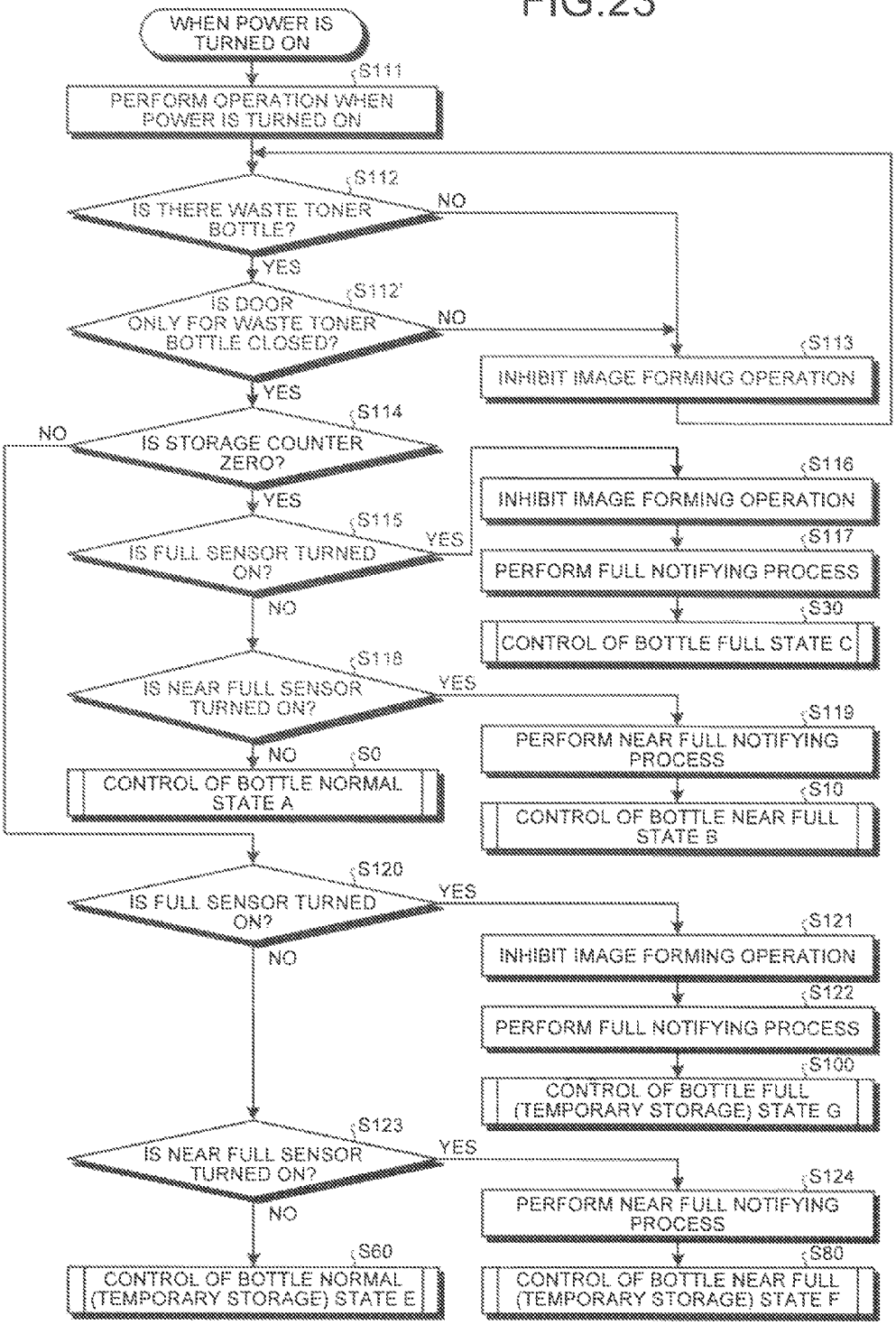
FIG. 23 is a flowchart illustrating the flow of control related to the replacement of a waste toner bottle when power is turned on in the modification.

FIG. 15 is a perspective view illustrating the closed state of a front door 6.

The image forming apparatus 1 includes front doors 6 and 7 used to handle devices in the apparatus during a paper jam process or unit maintenance. The door 8 only for a waste toner bottle which is used to replace the waste toner bottle 241 is provided in a portion of the front door 6. When the front door 6 is opened, as shown in FIG. 15, the door 8 only for a waste toner bottle is opened integrally with the front door 6. As shown in FIG. 14, it is possible to open only the door 8 only for a waste toner bottle, with the front door 6 closed. When the door 8 only for a waste toner bottle is opened (including the opening of the front door 6), it is possible to handle the waste toner bottle 241 arranged at the position shown in FIG. 1 so as to insert or remove the waste toner bottle 241.

The door 8 only for a waste toner bottle is provided with an opening/closing detection unit. When the opening/closing detection unit detects whether the door 8 only for a waste toner bottle is opened, in the nonstop waste toner bottle replacement control according to the modification, the same control process as that when the waste toner bottle 241 is removed in the nonstop waste toner bottle replacement control according to the above-described embodiment is performed. Specifically, FIGS. 16 to 23 show the flow of the nonstop waste toner bottle replacement control according to the modification.

When the front door 6 or the door 8 only for a waste toner bottle is opened, the user can access the waste toner collecting unit 240 including the waste toner bottle 241. However, in the modification, when the front door 6 or the door 8 only for a waste toner bottle is opened, a driving unit in, for example, the waste toner collecting unit 240 is stopped. Therefore, it is possible to prevent the user from accessing the driving unit that is currently operated.

The front door 6 or the door 8 only for a waste toner bottle is opened prior to the insertion or removal of the waste toner bottle 241. Therefore, in the modification in which the driving unit is stopped when the front door 6 or the door 8 only for a waste toner bottle is opened, when the waste toner bottle 241 is inserted or removed, the driving unit is completely stopped. Therefore, it is possible to reliably prevent, for example, toner leakage, as compared to the structure in which the driving unit is stopped when the waste toner bottle 241 is inserted or removed.

In the modification, as shown in FIG. 15, when the front door 6 is opened, the door 8 only for a waste toner bottle is opened integrally with the front door 6. In the nonstop waste toner bottle replacement control, even when the door 8 only for a waste toner bottle is opened or the waste toner bottle is inserted or removed during an image forming operation (print job), the image forming operation is continued. However, when the front door 6 is opened, electric components in, for example, the power supply and the driving unit are mechanically broken in order to prevent an electric shock or an injury. In this case, the nonstop waste toner bottle replacement control is not performed even during the image forming operation.

As described above, the image forming apparatus according to this embodiment includes: a photosensitive element which is an image carrier; a cleaning unit serving as a cleaning device that collects a waste toner, such as an excess toner attached to the surface of the photosensitive element, using a cleaning blade, which is a cleaning member; the waste toner bottle 241 serving as a waste container that can be inserted into or removed from the image forming apparatus body; the temporary storage unit 242 that is provided in the image forming apparatus body and temporarily stores a waste toner including the waste toner collected into the cleaning unit before the waste toner is transported to the waste toner bottle 241; the main-body-side waste toner transport member serving as a waste transport unit that transports the waste toner to the temporary storage unit 242; and the temporary storage unit transport screw 244 serving as a waste discharge unit that discharges the waste toner in the temporary storage unit 242 to the waste toner bottle 241. The image forming apparatus forms a toner image on the surface of the photosensitive element and transfers the formed toner image from the photosensitive element to the intermediate transfer belt 3, which is a transfer member, thereby forming an image. In the image forming apparatus, the discharge speed of the waste toner from the temporary storage unit 242 by the temporary storage unit transport screw 244 is higher than the transport speed of the waste toner to the temporary storage unit 242 by the main-body-side waste toner transport member. Therefore, in the normal state, it is possible to stably maintain the amount of waste toner in the temporary storage unit 242 to be the minimum value substantially close to an empty state. In addition, the image forming apparatus according to this embodiment includes the set detection sensor 246 serving as an insertion/removal detection unit that detects the insertion or removal of the waste toner bottle 241 into or from the image forming apparatus body. The control unit 10 provided in the image forming apparatus functions as a transport amount correlation information acquiring unit that acquires driving time information of the main-body-side waste toner transport member, which is transport amount correlation information correlated with the amount of waste toner transported to the temporary storage unit 242 by the main-body-side waste toner transport member, and the storage counter serving as an estimated transport amount determining unit that determines a count value, which is the estimated amount of waste toner transported to the temporary storage unit 242 by the main-body-side waste toner transport member after the set detection sensor 246 detects that the waste toner bottle 241 is removed from the image forming apparatus body, on the basis of the driving time information of the main-body-side waste toner transport member acquired by the control unit 10 after the detection of the removal of the waste toner bottle 241. When the count value of the storage counter reaches a predetermined value (storage threshold value), it is possible to determine whether the temporary storage unit 242 is in a full state. According to this structure, it is not necessary to provide a sensor for detecting whether the temporary storage unit 242 is in a full state. In this embodiment, the control unit 10 functions as a waste toner discharge control unit that stops the discharge of the waste toner from the temporary storage unit 242 by the temporary storage unit transport screw 244 when the set detection sensor 246 detects that the waste toner bottle 241 is removed from the image forming apparatus body, the control unit 10 and resumes the discharge of the waste toner from the temporary storage unit 242 by the temporary storage unit transport screw 244 when the set detection sensor 246 detects that the waste toner bottle 241 is inserted into the image forming apparatus body. In this way, it is possible to prevent the waste toner in the temporary storage unit 242 from overflowing into the apparatus when the waste toner bottle 241 is removed from the image forming apparatus body. The control unit 10 according to this embodiment functions as a waste toner transport control unit that directs the main-body-side waste toner transport member to continuously transport the waste toner to the temporary storage unit 242 until the count value of the storage counter reaches the storage threshold value, which is a predetermined value, when the set detection sensor 246 detects that the waste toner bottle 241 is removed from the image forming apparatus body, stops the transport of the waste toner to the temporary storage unit 242 by the main-body-side waste toner transport member when the count value of the storage counter reaches the storage threshold value before the set detection sensor 246 detects that the waste toner bottle 241 is inserted into the image forming apparatus body, and resumes the transport of the waste toner to the temporary storage unit 242 by the main-body-side waste toner transport member when the set detection sensor 246 detects that the waste toner bottle 241 is inserted into the image forming apparatus body. In this way, even when the waste toner bottle 241 is removed, it is possible to continuously perform the image forming operation for some time and the waste toner bottle 241 is replaced with a now one in that time. In this way, it is possible to complete the replacement of the waste toner bottle 241 without stopping the image forming operation. In addition, it is possible to prevent the amount of waste toner equal to or more than a permissible value from being transported into the temporary storage unit 242 when the waste toner bottle 241 is removed.

Therefore, it is possible to prevent the waste toner in the temporary storage unit 242 from being agglutinated and then hindering the discharge operation from the temporary storage unit 242, or it is possible to prevent the inside of the apparatus from being contaminated by the waste toner overflowing from the temporary storage unit 242.

In this embodiment, the control unit 10 functions as a discharge amount correlation information acquiring unit that acquires the driving time information of the temporary storage unit transport screw 244 as discharge amount correlation information correlated with the amount of waste toner discharged from the temporary storage unit 242 by the temporary storage unit transport screw 244 and a discharge counter serving as an estimated reduced amount determining unit that determines a count value, which is an estimated reduced amount after insertion obtained by subtracting an estimated transport amount after insertion which is determined on the basis of the driving time information of the main-body-side waste toner transport member acquired by the control unit 10 after the set detection sensor 246 detects that the waste toner bottle 241 is inserted into the image forming apparatus body from an estimated discharge amount after insertion which is determined on the basis of the driving time information of the temporary storage unit transport screw 244 acquired by the control unit 10 after the set detection sensor 246 detects that the waste toner bottle 241 is inserted into the image forming apparatus body. When the set detection sensor 246 detects that the waste toner bottle 241 is removed from the image forming apparatus body before the count value of the discharge counter reaches a discharge threshold value serving as a predetermined reduced amount, the control unit 10 stops the transport of the waste toner to the temporary storage unit 242 by the main-body-side waste toner transport member even before the storage counter reaches the storage threshold value. In this way, it is possible to reliably prevent an error (it is difficult to inhibit the image forming operation before the temporary storage unit 242 is full) due to an operation of determining whether the temporary storage unit 242 is in a full state on the assumption that the temporary storage unit 242 is in an empty state when the waste toner bottle 241 is removed before the temporary storage unit 242 is empty.

In this embodiment, the discharge threshold value may be determined on the basis of the count value of the storage counter until the insertion of the waste toner bottle is detected. When a constant discharge threshold value is used without using the count value of the storage counter, the time until the count value of the discharge counter reaches the discharge threshold value is constant regardless of the replacement time of the waste toner bottle. However, when the replacement time of the waste toner bottle is short, the amount of waste toner temporarily stored in the temporary storage unit is less than that when the replacement time of the waste toner bottle is long and the time required for the temporary storage unit to become an empty state after replacement is reduced. Therefore, when the replacement time of the waste toner bottle is short, the waste toner can be temporarily stored in the temporary storage unit (temporary storage unit storage state D) since the temporary storage unit 242 is empty. Nevertheless, when the waste toner bottle 241 is removed, it takes a long time for a process (image forming operation inhibition process) of stopping the transport of the waste toner to the temporary storage unit 242 by the main-body-side waste toner transport member is performed, which results in a waste of time. In contrast, when the discharge threshold value is determined on the basis of the count value of the storage counter until the insertion of the waste toner bottle is detected, it is possible to determine the discharge threshold value suitable for the amount of waste toner temporarily stored in the temporary storage unit. Therefore, it is possible to reduce the waste of time.

In this embodiment, when power is turned off before the count value of the discharge counter reaches the discharge threshold value and is then turned on, the control unit 10 performs the nonstop waste toner bottle replacement control using the count value of the discharge counter after power is turned on, instead of the count value of the discharge counter before power is turned on. In this case, even when power is turned off and the count value of the discharge counter is reset, it is possible to reliably prevent an operation error when the waste toner bottle 241 is removed before the temporary storage unit 242 is empty.

In the structure in which the count value of the discharge counter is periodically stored in a non-volatile memory, when power is turned on, the count value of the discharge counter is continuously measured from the count value before power is turned on. Therefore, it is possible to reliably prevent an operation error when the waste toner bottle 241 is removed before the temporary storage unit 242 is empty.

In this embodiment, since the count value of the storage counter is periodically stored in the non-volatile memory, it is possible to know the amount of waste toner in the temporary storage unit 242 when power is turned on. Therefore, it is possible to continuously perform the nonstop waste toner bottle replacement control from the count value of the storage counter.

In this embodiment, when the entire image forming operation (print job) corresponding to a received image formation command ends before the count value of the storage counter reaches the storage threshold value after the set detection sensor 246 detects that the waste toner bottle 241 is removed from the image forming apparatus body, the control unit 10 stops the transport of the waste toner to the temporary storage unit 242 by the main-body-side waste toner transport member until the set detection sensor 246 detects that the waste toner bottle 241 is inserted into the image forming apparatus body. In this way, it is possible to reduce the possibility of the image forming operation (print job) being interrupted.

In the modification, the image forming apparatus includes the door 8 only for a waste toner bottle, which is a door only for a waster container used to replace the waste container, and a dedicated door opening/closing detection unit that detects the opening or closing of the door 8 only for a waste toner bottle. In this way, it is possible to achieve nonstop waste toner bottle replacement control which is operatively associated with the opening/closing operation of the door 8 only for a waste toner bottle, similarly to the nonstop waste toner bottle replacement control according to the embodiment which is operatively associated with the insertion or removal of the waste toner bottle 241 into or from the image forming apparatus body. That is, in the modification, when the insertion of the waste toner bottle 241 is replaced with the closing of the door 8 only for a waste toner bottle and the removal of the waste toner bottle 241 is replaced with the opening of the door 8 only for a waste toner bottle in the embodiment, it is possible to achieve the same effect as that in the embodiment.

Specifically, the image forming apparatus may include: an estimated transport amount determining unit that determines the estimated amount of waste toner transported to the temporary storage unit by the waste transport unit after the dedicated door opening/closing detection unit detects that the door 8 only for a waste toner bottle is opened, on the basis of the transport amount correlation information acquired by the transport amount correlation information acquiring unit after the dedicated door opening/closing detection unit detects that the door 8 only for a waste toner bottle is opened; a waste discharge control unit that stops the discharge of the waste toner from the temporary storage unit by the waste discharge unit when the dedicated door opening/closing detection unit detects that the door 8 only for a waste toner bottle is opened and resumes the discharge of the waste toner from the temporary storage unit by the waste discharge unit when the insertion/removal detection unit detects that the waste container is inserted into the image forming apparatus body and the dedicated door opening/closing detection unit detects that the door 8 only for a waste toner bottle is closed; and a waste transport control unit that directs the waste transport unit to continuously transport the waste toner to the temporary storage unit until the estimated transport amount after the opening operation which is determined by the estimated transport amount determining unit reaches a predetermined amount when the dedicated door opening/closing detection unit detects that the door 8 only for a waste toner bottle is opened, stops the transport of the waste toner to the temporary storage unit by the waste transport unit when the estimated transport amount after the opening operation which is determined by the estimated transport amount determining unit reaches the predetermined amount before the dedicated door opening/closing detection unit detects that the door 8 only for a waste toner bottle is closed, and resumes the transport of the waste toner to the temporary storage unit by the waste transport unit when the insertion/removal detection unit detects that the waste container is inserted into the image forming apparatus body and the dedicated door opening/closing detection unit detects that the door 8 only for a waste toner bottle is closed.

In this case, a main body door (front door 6) for a paper jam process and unit maintenance and a main body door opening/closing detection unit that detects the opening or closing of the main body door may be provided. When the main body door opening/closing detection unit detects that the main body door is opened, the transport of the waste toner to the temporary storage unit by the waste transport unit may be stopped. In this structure, when the main body door is opened, the nonstop waste toner bottle replacement control may not be performed. In this case, the door 8 only for a waste toner bottle may be performed in a portion of the main body door. When the main body door is opened or closed, the door 8 only for a waste toner bottle may be opened or closed integrally with the main body door and the door 8 only for a waste toner bottle may be opened or closed with the main body door being closed. According to this structure, it is possible to use the dedicated door opening/closing detection unit as the main body door opening/closing detection unit.

In an aspect of the embodiments, the discharge speed of a waste from a temporary storage unit by a waste discharge unit is higher than the transport speed of the waste to the temporary storage unit by a waste transport unit. In this way, in a normal state after a predetermined period of time has elapsed from the insertion of a new waste container, the amount of waste in the temporary storage unit is stably maintained at a minimum value substantially close to an empty state. Therefore, according to the aspect of the embodiments, it is possible for the user to recognize that the temporary storage unit is full or nearly full by means of the following structure, even without using the buffer waste toner full sensor provided in the buffer (temporary storage unit) of the image forming apparatus as in the related art.

When the waste container is removed from an image forming apparatus body, first, the discharge of the waste from the temporary storage unit by the waste discharge unit is stopped to prevent the waste discharged from the temporary storage unit from leaking from a connection portion between the apparatus body and the waste container, thereby preventing the inside of the apparatus from being contaminated by the waste. When the waste container is inserted into the image forming apparatus body, the discharge of the waste from the temporary storage unit by the waste discharge unit is resumed and an operation of transporting the waste in the temporary storage unit to the waste container is resumed.

When the waste container is removed from the image forming apparatus body, the estimated amount of waste transported to the temporary storage unit after an insertion/removal detection unit detects that the waste container is removed from the image forming apparatus body is determined on the basis of transport amount correlation information after the insertion/removal detection unit detects that the waste container is removed from the image forming apparatus body. When the waste container is removed from the image forming apparatus body in the normal state in which the amount of waste in the temporary storage unit is maintained at the minimum value, the sum of the estimated transport amount after removal and the minimum storage amount is the estimated amount of waste in the temporary storage unit at the time when the estimated transport amount after removal is determined. Therefore, when the estimated transport amount after removal reaches a value obtained by subtracting the minimum storage amount from the full level of the temporary storage unit, it may be predicted that the temporary storage unit is full.

In the aspect of the embodiments, even when the waste container is removed from the image forming apparatus body, the waste transport unit continues to transport the waste to the temporary storage unit until the estimated transport amount after removal reaches a predetermined amount, on the basis of the above-mentioned prediction. In this way, until the estimated transport amount after removal reaches the predetermined amount, the waste sequentially generated through the image forming operation is stored in the temporary storage unit. Therefore, even when the waste container is removed from the image forming apparatus body, it is possible to continuously perform the image forming operation. When the estimated transport amount after removal reaches the predetermined amount before the waste container is inserted into the image forming apparatus body, the transport of the waste to the temporary storage unit by the waste transport unit is stopped. In this way, it is possible to prevent the amount of waste equal to or more than a permissible amount from being transported into the temporary storage unit. When the amount of waste equal to or more than the permissible amount is transported into the temporary storage unit, the waste in the temporary storage unit is agglutinated, which hinders the discharge of the waste from the temporary storage unit, or the inside of the apparatus is contaminated by the waste flowing out from the temporary storage unit. However, according to the aspect of the invention, it is possible to prevent the problem. As such, when the waste container is inserted into the image forming apparatus body after the transport of the waste to the temporary storage unit by the waste transport unit is stopped, the transport operation is resumed. In this way, both of the operation of the waste transport unit transporting the waste to the temporary storage unit and the operation of the waste discharge unit discharging the waste from the temporary storage unit at a discharge speed higher than the transport speed are resumed. As a result, when a predetermined period of time has elapsed from the resumption of the transport operation, the apparatus returns to the normal state in which the amount of waste in the temporary storage unit is maintained at the minimum value.

The predetermined amount may be a value obtained by subtracting the minimum storage amount from the full level of the temporary storage unit. In this case, it is preferable to consider a little margin.

In the above-mentioned structure, control is performed in operative association with the insertion or removal of the waste container into or from the image forming apparatus body. The invention may also be applied to control operatively associated with an operation of opening or closing a door only for a waster container.

According to the embodiments, it is possible to prevent the amount of waste toner equal to or more than a permissible amount from being transported into a temporary storage unit, without providing a sensor in the temporary storage unit provided in order to continuously perform an image forming operation even when a waste container is removed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms a toner image on a surface of an image carrier and transfers the formed toner image from the image carrier to a transfer body, thereby forming an image, comprising:

a cleaning device that collects a waste toner attached to the surface of the image carrier using a cleaning member;

a waste container that is removable from an image forming apparatus body;

a temporary storage unit that is provided in the image forming apparatus body to temporarily store a waste including the waste toner collected in the cleaning device before the waste is transported to the waste container;

a waste transport unit that transports the waste to the temporary storage unit at a transport speed;

a waste discharge unit that discharges the waste stored in the temporary storage unit to the waste container, the waste discharge unit being configured to discharge the waste from the temporary storage unit at a discharge speed that is lower than the transport speed of the waste to the temporary storage unit by the waste transport unit;

a transport amount correlation information acquiring unit that acquires transport amount correlation information correlated with the amount of waste transported into the temporary storage unit by the waste transport unit, the transport amount correlation information being a transport operation time of the waste transport unit;

an insertion/removal detection unit that detects the insertion or removal of the waste container into or from the image forming apparatus body;

an estimated transport amount determining unit that determines an estimated amount of waste after removal, which is transported to the temporary storage unit by the waste transport unit after the detection of the removal of the waste container, on the basis of the transport amount correlation information acquired by the transport amount correlation information acquiring unit after the insertion/removal detection unit detects that the waste container is removed from the image forming apparatus body;

a waste discharge control unit that stops the discharge of the waste from the temporary storage unit by the waste discharge unit when the insertion/removal detection unit detects that the waste container is removed from the image forming apparatus body, and resumes the discharge of the waste from the temporary storage unit by the waste discharge unit when the insertion/removal detection unit detects that the waste container is inserted into the image forming apparatus body; and a waste transport control unit that directs the waste transport unit to continuously transport the waste to the temporary storage unit until the estimated transport amount after removal, which is determined by the estimated transport amount determining unit, reaches a predetermined amount when the insertion/removal detection unit detects that the waste container is removed from the image forming apparatus body, directs the waste transport unit to stop the transport of the waste to the temporary storage unit when the estimated transport amount after removal, which is determined by the estimated transport amount determining unit, reaches the predetermined amount before the insertion/removal detection unit detects that the waste container is inserted into the image forming apparatus body, and directs the waste transport unit to resume the transport of the waste to the temporary storage unit if the operation of transporting the waste to the temporary storage unit by the waste transport unit is stopped when the insertion/removal detection unit detects that the waste container is inserted into the image forming apparatus body.

2. The image forming apparatus according to claim 1, wherein the estimated transport amount determining unit periodically stores the estimated transport amount after removal in a non-volatile memory.

3. The image forming apparatus according to claim 1, wherein, when an image forming operation corresponding to a received image formation command ends before the estimated transport amount after removal determined by the estimated transport amount determining unit reaches the predetermined amount after the insertion/removal detection unit detects that the waste container is removed from the image forming apparatus body, the waste transport control unit stops the transport of the waste to the temporary storage unit by the waste transport unit until the insertion/removal detection unit detects that the waste container is inserted into the image forming apparatus body.

4. The image forming apparatus according to claim 1, further comprising:

a storage counter that counts the transport operation time of the waste transport unit.

5. The image forming apparatus according to claim 1, wherein the temporary storage unit does not include a sensor to detect when the temporary storage unit is in a full state or an empty state.

6. An image forming apparatus that forms a toner image on a surface of an image carrier and transfers the formed toner image from the image carrier to a transfer body, thereby forming an image, comprising:

a cleaning device that collects a waste toner attached to the surface of the image carrier using a cleaning member;

a waste container that is removable from an image forming apparatus body;

a temporary storage unit that is provided in the image forming apparatus body to temporarily store a waste including the waste toner collected in the cleaning device before the waste is transported to the waste container;

a waste transport unit that transports the waste to the temporary storage unit at a transport speed;

a waste discharge unit that discharges the waste stored in the temporary storage unit to the waste container, the waste discharge unit being configured to discharge the waste from the temporary storage unit at a discharge speed that is lower than the transport speed of the waste to the temporary storage unit by the waste transport unit;

a transport amount correlation information acquiring unit that acquires transport amount correlation information correlated with the amount of waste transported into the temporary storage unit by the waste transport unit;

an insertion/removal detection unit that detects the insertion or removal of the waste container into or from the image forming apparatus body;

an estimated transport amount determining unit that determines an estimated amount of waste after removal, which is transported to the temporary storage unit by the waste transport unit after the detection of the removal of the waste container, on the basis of the transport amount correlation information acquired by the transport amount correlation information acquiring unit after the insertion/removal detection unit detects that the waste container is removed from the image forming apparatus body;

a waste discharge control unit that stops the discharge of the waste from the temporary storage unit by the waste discharge unit when the insertion/removal detection unit detects that the waste container is removed from the image forming apparatus body, and resumes the discharge of the waste from the temporary storage unit by the waste discharge unit when the insertion/removal detection unit detects that the waste container is inserted into the image forming apparatus body;

a waste transport control unit that directs the waste transport unit to continuously transport the waste to the temporary storage unit until the estimated transport amount after removal, which is determined by the estimated transport amount determining unit, reaches a predetermined amount when the insertion/removal detection unit detects that the waste container is removed from the image forming apparatus body, directs the waste transport unit to stop the transport of the waste to the temporary storage unit when the estimated transport amount after removal, which is determined by the estimated transport amount determining unit, reaches the predetermined amount before the insertion/removal detection unit detects that the waste container is inserted into the image forming apparatus body, and directs the waste transport unit to resume the transport of the waste to the temporary storage unit if the operation of transporting the waste to the temporary storage unit by the waste transport unit is stopped when the insertion/removal detection unit detects that the waste container is inserted into the image forming apparatus body;

a discharge amount correlation information acquiring unit that acquires discharge amount correlation information correlated with the amount of waste discharged from the temporary storage unit by the waste discharge unit; and an estimated reduced amount determining unit that determines an estimated reduced amount after insertion obtained by subtracting an estimated transport amount after insertion which is determined based on the transport amount correlation information acquired by the transport amount correlation information acquiring unit after the insertion/removal detection unit detects that the waste container is inserted into the image forming apparatus body from an estimated discharge amount after insertion which is determined based on the discharge amount correlation information acquired by the discharge amount correlation information acquiring unit after the detection of the insertion, wherein, when the insertion/removal detection unit detects that the waste container is removed from the image forming apparatus body before the estimated reduced amount after insertion determined by the estimated reduced amount determining unit reaches a predetermined reduced amount, the waste transport control unit stops the transport of the waste to the temporary storage unit by the waste transport unit even before the estimated transport amount after insertion determined by the estimated transport amount determining unit reaches the predetermined amount.

7. The image forming apparatus according to claim 6, wherein the predetermined reduced amount is determined based on the estimated transport amount after removal which is determined by the estimated transport amount determining unit until the insertion of the waste container is detected.

8. The image forming apparatus according to claim 6, wherein, when power is turned off before the estimated reduced amount after removal reaches the predetermined reduced amount and is then turned on, instead of the estimated reduced amount after removal, the estimated reduced amount determining unit determines an estimated reduced amount after power on obtained by subtracting an estimated transport amount after power on which is determined based on the transport amount correlation information acquired by the transport amount correlation information acquiring unit after power is turned on from an estimated discharge amount after power on which is determined based on the discharge amount correlation information acquired by the discharge amount correlation information acquiring unit after power is turned on, and the waste transport control unit controls the stopping of the transport operation using the estimated reduced amount after power on which is determined by the estimated reduced amount determining unit, instead of the estimated reduced amount after insertion.

9. The image forming apparatus according to claim 6, wherein the estimated reduced amount determining unit periodically stores the estimated reduced amount after insertion in a non-volatile memory.

10. The image forming apparatus according to claim 6, wherein the discharge amount correlation information acquiring unit acquires a discharge operation time of the waste discharge unit as the discharge amount correlation information.

11. An image forming apparatus that forms a toner image on a surface of an image carrier and transfers the formed toner image from the image carrier to a transfer body, thereby forming an image, comprising:

a cleaning device that collects a waste toner attached to the surface of the image carrier using a cleaning member;

a waste container that is removable from an image forming apparatus body;

a temporary storage unit that is provided in the image forming apparatus body to temporarily store a waste including the waste toner collected in the cleaning device before the waste is transported to the waste container;

a waste transport unit that transports the waste to the temporary storage unit;

a waste discharge unit that discharges the waste stored in the temporary storage unit to the waste container, wherein a discharge speed of the waste from the temporary storage unit by the waste discharge unit is higher than a transport speed of the waste to the temporary storage unit by the waste transport unit;

a door only for a waste container that is used to replace the waste container;

a transport amount correlation information acquiring unit that acquires transport amount correlation information correlated with the amount of waste transported to the temporary storage unit by the waste transport unit, the transport amount correlation information being a transport operation time of the waste transport unit;

an insertion/removal detection unit that detects the insertion or removal of the waste container into or from the image forming apparatus body;

a dedicated door opening/closing detection unit that detects the opening or closing of the door only for a waste container;

an estimated transport amount determining unit that determines an estimated amount of waste after an opening operation which is transported to the temporary storage unit by the waste transport unit after the dedicated door opening/closing detection unit detects that the door only for a waste container is opened, based on the transport amount correlation information acquired by the transport amount correlation information acquiring unit after the dedicated door opening/closing detection unit detects that the door only for a waste container is opened;

a waste discharge control unit that stops the discharge of the waste from the temporary storage unit by the waste discharge unit when the dedicated door opening/closing detection unit detects that the door only for a waste container is opened, and resumes the discharge of the waste from the temporary storage unit by the waste discharge unit when the insertion/removal detection unit detects that the waste container is inserted into the image forming apparatus body and the dedicated door opening/closing detection unit detects that the door only for a waste container is closed; and a waste transport control unit that directs the waste transport unit to continuously transport the waste to the temporary storage unit until the estimated transport amount after an opening operation which is determined by the estimated transport amount determining unit reaches a predetermined amount when the dedicated door opening/closing detection unit detects that the door only for a waste container is opened, directs the waste transport unit to stop the transport of the waste to the temporary storage unit when the estimated transport amount after an opening operation which is determined by the estimated transport amount determining unit reaches the predetermined amount before the dedicated door opening/closing detection unit detects that the door only for a waste container is closed, and directs the waste transport unit to resume the transport of the waste to the temporary storage unit when the insertion/removal detection unit detects that the waste container is inserted into the image forming apparatus body and the dedicated door opening/closing detection unit detects that the door only for a waste container is closed.

12. The image forming apparatus according to claim 11, further comprising:

a main body door through which the inside of the image forming apparatus is exposed to the outside; and a main body door opening/closing detection unit that detects the opening or closing of the main body door, wherein, when the main body door opening/closing detection unit detects that the main body door is opened, the waste transport control unit stops the transport of the waste to the temporary storage unit by the waste transport unit.

13. The image forming apparatus according to claim 11, further comprising:

a discharge amount correlation information acquiring unit that acquires discharge amount correlation information correlated with the amount of waste discharged from the temporary storage unit by the waste discharge unit; and an estimated reduced amount determining unit that determines an estimated reduced amount after a closing operation obtained by subtracting an estimated transport amount after a closing operation which is determined based on the transport amount correlation information acquired by the transport amount correlation information acquiring unit after a detection of the closing operation from an estimated discharge amount after a closing operation which is determined based on the discharge amount correlation information acquired by the discharge amount correlation information acquiring unit after the insertion/removal detection unit detects that the waste container is inserted into the image forming apparatus body and the dedicated door opening/closing detection unit detects that the door only for a waste container is closed, wherein, when the insertion/removal detection unit detects that the waste container is removed from the image forming apparatus body or the dedicated door opening/closing detection unit detects that the door only for a waste container is opened before the estimated reduced amount after a closing operation which is determined by the estimated reduced amount determining unit reaches a predetermined reduced amount, the waste transport control unit stops the transport of the waste to the temporary storage unit by the waste transport unit even before the estimated transport amount after an opening operation which is determined by the estimated transport amount determining unit reaches the predetermined amount.

14. The image forming apparatus according to claim 13, wherein the predetermined reduced amount is determined based on the estimated transport amount after an opening operation which is determined by the estimated transport amount determining unit until the opening of the door only for a waste container is detected.

15. The image forming apparatus according to claim 13, wherein, when power is turned off before the estimated reduced amount after a closed operation reaches the predetermined reduced amount and is then turned on, instead of the estimated reduced amount after a closing operation, the estimated reduced amount determining unit determines an estimated reduced amount after power on obtained by subtracting an estimated transport amount after power on which is determined based on the transport amount correlation information acquired by the transport amount correlation information acquiring unit after power is turned on from an estimated discharge amount after power on which is determined based on the discharge amount correlation information acquired by the discharge amount correlation information acquiring unit after power is turned on, and the waste transport control unit controls the stopping of the transport operation using the estimated reduced amount after power on which is determined by the estimated reduced amount determining unit, instead of the estimated reduced amount after a closing operation.

16. The image forming apparatus according to claim 11, wherein, when the entire image forming operation corresponding to a received image formation command ends before the estimated transport amount after an opening operation determined by the estimated transport amount determining unit reaches the predetermined amount after the insertion/removal detection unit detects that the waste container is removed from the image forming apparatus body or after the dedicated door opening/closing detection unit detects that the door only for a waste container is opened, the waste transport control unit stops the transport of the waste to the temporary storage unit by the waste transport unit until the insertion/removal detection unit detects that the waste container is inserted into the image forming apparatus body and the dedicated door opening/closing detection unit detects that the door only for a waste container is closed.

17. The image forming apparatus according to claim 11, further comprising:

a storage counter that counts the transport operation time of the waste transport unit.

18. The image forming apparatus according to claim 11, wherein the temporary storage unit does not include a sensor to detect when the temporary storage unit is in a full state or an empty state.

* * * * *